US006241044B1

(12) United States Patent
Nishiyama et al.

(10) Patent No.: US 6,241,044 B1
(45) Date of Patent: Jun. 5, 2001

(54) EXHAUST SILENCER AND COMMUNICATING PIPE THEREOF

(75) Inventors: Toshihiko Nishiyama; Rie Katayama, both of Oyama (JP)

(73) Assignee: Komatsu Ltd., Tokyo (JP)

( * ) Notice: Subject to any disclaimer, the term of this patent is extended or adjusted under 35 U.S.C. 154(b) by 0 days.

(21) Appl. No.: 09/497,851

(22) Filed: Feb. 4, 2000

(30) Foreign Application Priority Data

Feb. 5, 1999 (JP) ..... 11-029207
Dec. 9, 1999 (JP) ..... 11-350315

(51) Int. Cl.[7] ..... F01N 1/08

(52) U.S. Cl. ..... 181/272; 181/281; 181/282; 181/269; 181/268; 181/227; 181/228; 181/251; 181/255

(58) Field of Search ..... 181/272, 275, 181/281, 282, 269, 268, 264, 227, 228, 247, 248, 249, 251, 255

(56) References Cited

U.S. PATENT DOCUMENTS 3,987,868 * 10/1976 Betts ..... 181/57
4,149,611 * 4/1979 Taguchi ..... 181/252
4,192,403 * 3/1980 Nakagawa et al. ..... 181/268
4,296,832 * 10/1981 Kicinski ..... 181/255
4,341,284 * 7/1982 Moore et al. ..... 181/272
4,367,808 * 1/1983 Oberg ..... 181/272
4,450,932 * 5/1984 Khosropour et al. ..... 181/211
4,487,289 * 12/1984 Kicinski et al. ..... 181/252
5,183,976 * 2/1993 Plemons, Jr. ..... 181/264
5,902,970 * 5/1999 Ferri ..... 181/249
6,116,377 * 9/2000 Dugan ..... 181/272

FOREIGN PATENT DOCUMENTS 2 589 195 * 4/1987 (FR) ..... 181/255
60-132014 * 7/1985 (JP) ..... 181/272
11-22444 1/1999 (JP) .

* cited by examiner

*Primary Examiner*—Robert E. Nappi
*Assistant Examiner*—Edgardo San Martin
(74) *Attorney, Agent, or Firm*—Armstrong, Westerman, Hattori, McLeland & Naughton, LLP

(57) ABSTRACT

More than two damping chambers 2A to 2C), a communicating pipe (6) for intercommunicating the damping chambers (2A, 2B) and another communicating pipe (7) for intercommunicating the damping chambers (2B, 2C) are provided. Both ends of the communicating pipes (6, 7) are closed by an end plate (9) and the respective damping chambers (2A to 2C) and inside of the communicating pipes (6, 7) are intercommunicated by communicating holes (8A) on an outer circumference of the communicating pipes (6, 7). Exhaust gas flows from the damping chamber (2A) to communicating holes (8A1), inside of the communicating pipe (6), communicating holes (8A2), the damping chamber (2B), communicating holes (8A3), inside of the communicating pipe (7), communicating holes (8A4), and the damping chamber (2C), thus damping exhaust noise by repeated effective contraction and expansion.

12 Claims, 15 Drawing Sheets

EXHAUST SILENCER AND COMMUNICATING PIPE THEREOF

BACKGROUND OF THE INVENTION

1. Field of the Invention

The present invention relates to an exhaust silencer of an internal combustion engine used for construction equipment and the like and a communicating pipe thereof.

2. Description of Related Art

An exhaust silencer called a "muffler" is connected to an exhaust pipe of an internal combustion engine used for a construction equipment etc. for reducing exhaust noise from a combustion chamber.

Conventionally, various arrangements are known for the exhaust silencer. In an internal combustion engine of construction equipment, a multistage-expansion type in which sound is damped by repeating contraction and expansion of exhaust gas and a resonant type in which the exhaust gas is resonated for damping sound are known as conventional examples of the exhaust silencer.

A conventional example of the multistage-expansion type exhaust silencer is shown in FIG. 15.

In FIG. 15, the conventional exhaust silencer 100 has three partitions 52A to 52C aligned in an axial direction for partitioning an inside of a drum-shaped body 51 into four chambers 51A to 51D, a communicating pipe 53 supported by the partitions 52A to 52C coaxially with the body 51, an inlet pipe 54 with an end and intermediate portion thereof being secured to the body 51 to face the uppermost-stream chamber 51A, and an outlet pipe 55 with an end and intermediate portion thereof being secured to the body 51 to face the lowermost-stream chamber 51D.

Among the partitions 52A to 52C, a large opening 52D to intercommunicate adjacent chambers is formed on the partitions 52A and 52C supporting both end sides of the communicating pipe 53. Both ends 53A of the communicating pipe 53 respectively facing the first chamber 51A and the fourth chamber 51D is closed, and a large number of communicating hole 53B is formed on a circumference of the communicating pipe 53.

An end 54A of the inlet pipe 54 is closed and a plurality of communicating hole 54B is formed on a circumference of the communicating pipe 54. The outlet pipe 55 has a plurality of communicating hole 55B and an end being open to the air.

Flow of the exhaust gas sent from the outlet pipe is straightened in radial direction by the communicating holes 54B of the inlet pipe 54 and is sent to the first chamber 51A, and the exhaust gas is damped by being sent from the first chamber 51A to the second chamber 51B through the opening 52D. Subsequently, the exhaust gas flows to inside of the communicating pipe 53 through the communicating holes 53B, circulates with angle thereof being changed into an axial direction, and is sent to the third chamber 51C through the communicating holes 53B. Further, the exhaust gas is sent from the third chamber 51C to the fourth chamber 51D through the opening 52D to flow into the outlet pipe 55 through the communicating holes 55B, which is discharged into the air.

Accordingly, the circulating exhaust gas repeatedly experiences total of four contractions and expansions by the two openings 52D and the two communicating holes 53B, thereby conducting so-called multistage-expansion type damping. Especially, the exhaust gas passes a predetermined length (a predetermined time) in the communicating pipe 53 while being contracted without full expansion, thus experiencing effective damping effect.

However, following disadvantage occurs in the multistage-expansion type exhaust silencer.

Though the opening 52D for contracting the exhaust gas is formed on the partitions 52A and 52C for dividing adjacent chambers, sufficient damping effect cannot be obtained when the opening area of the opening 52D is large.

More specifically, the opening 52D is an opening formed on the partitions 52A and 52C and there is only small length in the gas flow direction. Accordingly, rectification effect is deteriorated when the opening are is enlarged in accordance with increase in flow velocity of the exhaust gas.

Accordingly, when the rectification effect is lowered by enlarging the opening 52D of the respective partitions 52A and 52C in the conventional example, though there are apparently four damping chambers (the first chamber 51A to the fourth chamber 51D), only two practically effective damping chambers, i.e. upstream chamber and lower-stream chamber provided on both sides of the central partition 52B, can be established, which deteriorates noise reduction effect.

A conventional example of resonant type exhaust silencer will be described below.

Generally, the resonant type exhaust silencer has a plurality of chamber inside drum-shaped body divided by partitions, a part of the plurality of chambers being a resonant chamber for damping the exhaust noise.

For example, the resonant chamber is formed on a position between two damping chambers. A communicating pipe stretches over the two damping chambers sandwiching the resonant chamber and passes through the resonant chamber. An intermediate portion of the communicating pipe is exposed to the resonant chamber, and a large number of communicating holes are formed on a circumference of the intermediate portion to intercommunicate an inside of the communicating pipe and an inside of the resonant chamber.

A substantial part of the exhaust gas sent from the upstream damping chamber is sent to the lower-stream chamber through the communicating pipe and the rest is sent to the resonant chamber through the communicating holes. The exhaust gas (pressure wave thereof) reflects in the resonant chamber to reduce energy thereof especially on a resonant range thereof. The exhaust gas returned from the resonant chamber to the communicating pipe by pulsation etc. joins the exhaust gas flowing toward the lower-stream dumping chamber.

However, following problems occur in the resonant type exhaust silencer.

First, only specific frequency of the exhaust noise is damped in the resonant chamber and noise reduction for the entire range of the exhaust noise cannot be expected.

Since the resonant chamber has to be tuned for each type of the internal combustion engine, which complicates design and deteriorates at none-tuned frequency.

Further, since a large space is required for the exhaust silencer to have the resonant chamber, the size of the exhaust silencer itself has to be made large.

A combination of the above multistage-expansion type and the resonant type has been developed.

Since the ordinary multistage-expansion type exhaust silencer alternately circulates the exhaust gas between the inside of the pipe and the damping chamber through a pipe hole to damp the exhaust noise, resistance is caused to raise backpressure by repeating contraction and expansion of the exhaust gas passing the pipe hole.

To solve the above disadvantage, a control valve has been used for controlling the backpressure (Japanese Patent Laid-Open Publication No. Hei 11-22444).

Though the above arrangement is basically a multistage-expansion type having a plurality of damping chamber inside a cylindrical shell, a communicating pipe passing through, for instance, three damping chambers are provided, and a controllably openable control valve is provided inside the communicating pipe to a position corresponding to an intermediate chamber.

At low engine speed, the control valve is closed to shut the communicating pipe. Accordingly, the exhaust gas passing the communicating pipe enters into the intermediate damping chamber from upstream side relative to the control valve and is discharged to lower-stream side of the communicating pipe relative to the control valve. In other words, the intermediate damping chamber functions as a multistage-expansion type exhaust silencer, so that damping effect can be improved.

On the other hand, the control valve is opened at high engine speed to release shutting of the communicating pipe. Accordingly, a part of the exhaust gas passing the communicating pipe directly flows into the lower-stream damping chamber and another part enters into and go out of the intermediate damping chamber, so that the intermediate damping chamber works as a resonant chamber. Accordingly, damping effect by the resonant chamber can be obtained while largely reducing the exhaust resistance at the communicating pipe.

However, there can be following disadvantage in the above arrangement.

Though pressure loss of exhaust gas can be avoided at a high engine speed, damping effect covering entire sound range as in the multistage-expansion type cannot be obtained and noise of specific frequency can only be reduced by the resonant effect.

Further, since the control valve is used, a movable portion is required in a high-temperature portion, thus lacking reliability.

SUMMARY OF THE INVENTION

An object of the present invention is to provide an exhaust silencer and communicating pipe thereof capable of sufficiently damping exhaust noise.

Another object of the present invention is to provide an exhaust silencer capable of reducing pressure loss of exhaust gas and sufficiently damping exhaust noise.

An exhaust silencer according to the present invention is connected to an outlet pipe of an internal combustion engine. The exhaust silencer includes: a plurality of damping chambers of more than two, the plurality of damping chambers having an uppermost-stream damping chamber having an exhaust gas inlet for directly introducing exhaust gas of the internal combustion engine, and lowermost-stream damping chamber having an exhaust gas outlet for discharging the exhaust gas; and a communicating pipe for intercommunicating predetermined space of the plurality of damping chambers, the communicating pipe having an end plate on both ends and a number of communicating holes on an outer circumference at a predetermined position corresponding to the damping chamber to be interconnected.

According to the present invention, the exhaust gas generated in the internal combustion engine initially directly flows into the exhaust gas inlet to be sent to the upper-most damping chamber for expansion, thus damping the exhaust noise. Since the predetermined space of the plurality of (more than two) damping chambers including the uppermost-stream damping chamber is intercommunicated by the communicating tube and the communicating tube has the end plates on both sides and a large number of communicating holes on a circumference thereof, the exhaust gas flowed into the uppermost-stream damping chamber is sent from the radial direction to the inside of the pipe while being contracted by the communicating holes. Subsequently, the exhaust gas moves in the pipe in the axial direction and is sent and expanded into the next damping chamber after being contracted by the communicating holes. Further, the exhaust gas is sent into the damping chamber, the next damping chamber and, finally, the lowermost-stream damping chamber through the communicating pipe and is discharged to the outside through the exhaust gas outlet.

In other words, the exhaust gas experiences repeated contraction and expansion by the communicating holes of the communicating pipe when the exhaust gas is sent to the lower-stream damping chamber, so that the pressure thereof is lost and the energy is damped by changing flow in the axial direction and the radial direction, thus obtaining sufficient dumping effect.

Especially, the exhaust gas is always kept in a contracted status between the damping chambers for a predetermined length by the communicating pipe, thereby obtaining secure damping effect.

In the present invention, a total opening area of the communicating holes on the communicating pipe open to the uppermost-stream damping chamber may preferably smaller than respective total opening area of the communicating holes open to lower-stream damping chamber.

According to the above arrangement, since the exhaust gas enters from a small opening and flows out from a large opening, the exhaust gas is substantially expanded, thus obtaining good noise reduction effect of the exhaust gas and the jet noise generated in the upstream side does not remain to the lower-stream side.

In the present invention, a volume of the damping chamber on the uppermost-stream side may preferably be the largest of the plurality of damping chambers.

According to the above arrangement, since the damping chamber on the uppermost-stream side has a sufficient volume, the exhaust gas just introduced into the exhaust silencer from the outside rapidly expands, thus reducing the exhaust noise more effectively.

In the present invention, a volume of a damping chamber to which the communicating holes of the communicating pipe having the least total opening area directly opens may preferably the largest.

According to the above arrangement, since the exhaust gas contracted to the minimum by the communicating pipe having the least total opening area is introduced into the damping chamber having the largest volume, the exhaust gas sent into the damping chamber rapidly expands, thus more effectively reducing the exhaust noise.

In the present invention, a communicating portion for flowing the exhaust gas in an axial direction may preferably be provided to the end plates on either or both ends of the communicating pipe.

In other words, the end plates on both sides of the communicating pipe may not be necessarily completely closed, but may have semi-closed structure having the communicating portion such as small holes on the end plates as long as the flow-in and flow-out of the exhaust gas from the communicating holes on the outer circumference of the communicating pipe can be substantially conducted.

According to the above arrangement, the communicating portion provided to the end plates of the communicating pipe can be used as an aid of the communicating holes provided to a circumference of the communicating tube.

In the present invention, a cross section of the upstream communicating pipe may preferably be smaller than lower-stream communicating pipe.

When the cross-section becomes larger toward the lower-stream, the flow velocity of the exhaust gas in the communicating pipe can be lowered as going down to the lower-stream or the exhaust gas in the communicating pipe expands, thus reducing jet noise generated in the communicating pipe.

In the present invention, an entirety of the communicating pipe may preferably be formed of a single consecutive communicating pipe; and a communicating pipe cutoff partition may preferably be formed to an intermediate position of respective damping chambers except for the uppermost-stream damping chamber and the lowermost-stream damping chamber.

According to the above arrangement, since it is not required to dispose the plurality of the communicating pipe in the same damping chamber parallel in axial direction, the size of the exhaust silencer can be reduced. Further since the structure is simple, the silencer can be provided at a low cost.

In the above arrangement, a partitioning wall for partitioning a part of the respective damping chambers may preferably be provided to an outer circumference of the cutoff partition.

According to the above arrangement, since the exhaust gas flowing out of the upstream communicating holes of the cutoff partition flows into the lower-stream communicating holes passing over the partitioning wall, the exhaust gas seemingly goes through another damping chamber, thus performing sufficient damping effect.

In the present invention, an opening area of the communicating holes of the communicating pipe may preferably become smaller toward lower-stream side in exhaust flow direction.

According to the above arrangement, though the exhaust gas sent in the communicating pipe in the axial direction tries to concentrate around the lower-stream partition to flow out from the communicating holes, since the opening area of the communicating holes becomes smaller toward the lower-stream of the communicating pipe, the exhaust gas does not concentrate to a predetermined portion but flows out uniformly from the communicating holes aligned in the axial direction, thus reducing jet noise generated in the communicating pipe. In other words, the exhaust gas can more easily flow out as approaching toward the upper-stream, and an effect similar to narrowing the lower-stream pipe can be obtained.

In the present invention, a communicating portion for bypassing the exhaust gas may preferably provided to a partitioning portion for partitioning mutually adjacent damping chambers.

In other words, the partitioning portion for dividing the mutually adjacent damping chambers may not be completely closed but may be semi-closed for by-passing the exhaust gas by the communicating portion such as small holes formed on the partitioning portion.

According to the above arrangement, the communicating portion provided to the partitioning portion can be used as an aid for the communicating holes provided to the communicating pipe.

Another aspect of the present invention is a communicating pipe used for an exhaust silencer having a plurality of damping chamber; the plurality of damping chambers having an uppermost-stream damping chamber an exhaust gas inlet for directly introducing exhaust gas of the internal combustion engine, and lowermost-stream damping chamber having an exhaust gas outlet for discharging the exhaust gas. The communicating pipe is used for intercommunicating a predetermined chambers of the plurality of damping chambers, which is characterized in having: an end plate provided at least to a lower-stream end; and a large number of communicating holes provided to a predetermined position on an outer circumference corresponding to the chamber to be intercommunicated, the end plate on the lower-stream end being a hollow plate dented toward inside.

Conical shape, spherical shape can be listed as an example of the configuration of the hollow plate.

Ordinarily, since the exhaust gas flowing in the communicating pipe in the axial direction bumps into the end plate to flow out of the communicating holes adjacent to the end plate, when the velocity distribution and the outflow distribution flowing out from the communicating holes of the communicating pipe are observed, the velocity distribution or the outflow distribution adjacent to the end plate is large, which becomes smaller as far from the end plate. Accordingly, uniform flow cannot be obtained at a position adjacent to the end plate.

On the other hand, the exhaust gas sent in the axial direction inside the communicating pipe more easily flows in the radial direction by the end plate formed of the hollow plate according to the present invention. Further, since the flow path becomes narrower as approaching toward the lower-stream, the exhaust gas flowing out of the pipe by bumping into the end plate can easily flow in the radial direction from the communicating holes, thus reducing jet noise generated in the communicating pipe.

A further aspect of the present invention is an exhaust silencer connected to an outlet pipe of a combustion engine for damping exhaust noise by contracting and expanding a flow path for exhaust gas to be circulated, comprising: a main flow path for circulating majority of the exhaust gas; and at least one by-path flow path for constantly circulating a part of the exhaust gas.

According to the present invention, since a part of the exhaust gas discharged from the internal combustion engine flows through the by-path flow path as well as the main flow path, loss caused by exhaust pressure applied to the main flow path can be prevented from being excessively high. When a by-pass flow path having on-off valve is provided in addition to the main flow path, a large backpressure is applied to the main flow path by shutting the by-pass flow path accidentally by the on-off valve. However, when the exhaust gas constantly circulates in the by-path flow path, large backpressure is not applied to the main flow path.

Further, since the exhaust gas joins after separately circulating the main flow path and the by-path flow path so that the exhaust noise (sound wave) mutually interferes and damps, the exhaust noise can be reduced.

In the present invention, cross section of the sub flow path may preferably be defined so that amount of the exhaust gas circulating therein is 5 to 30% of total exhaust gas circulating in the entire silencer.

According to the present invention, the effect of the above arrangement can be more securely attained by setting the amount of the exhaust gas in the by-path flow path.

Specifically, when the above value is less than 5%, the pressure loss of exhaust gas becomes too high, and when the above value exceeds 30%, the damping effect obtained by contraction and expansion of the flow path for circulating the exhaust gas becomes insufficient.

In the present invention, the exhaust silencer may further include a plurality of damping chamber, a partition for dividing the plurality of the damping chamber, and a communicating pipe for intercommunicating the plurality of the damping chamber, the partition having at least one communicating portion for circulating the exhaust gas.

According to the above arrangement, since the exhaust silencer is composed of the damping chambers, the partition and the communicating pipe, and the communicating portion constituting the by-path flow path are formed on the partition, the size of the entire silencer can be made small.

DETAILED DESCRIPTION OF PREFERRED EMBODIMENT(S)

Figure 1:
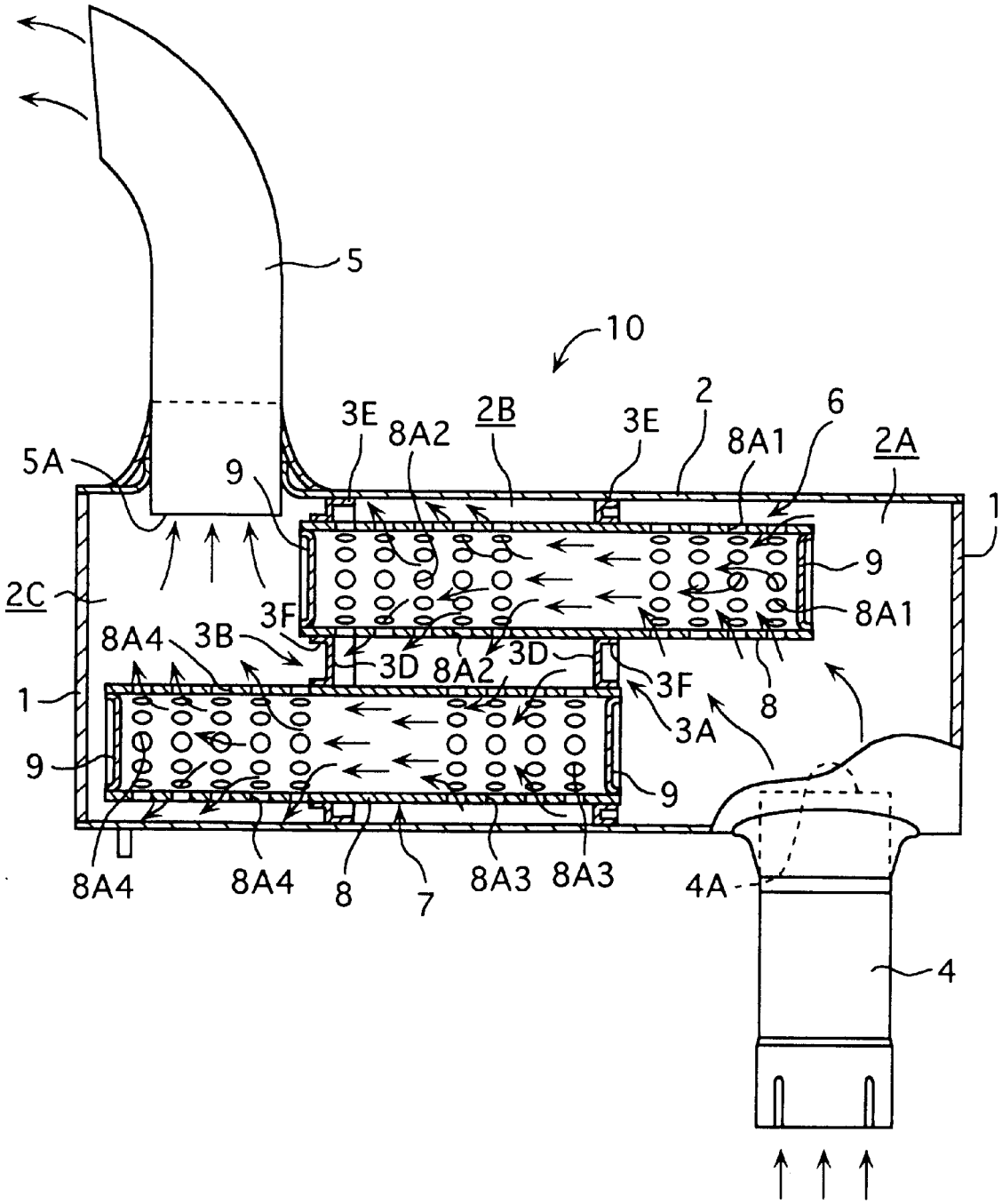
FIG. 1 is a cross section showing entire structure of an exhaust silencer according to first embodiment of the present invention.

Embodiments of the present invention will be described below with reference to attached drawings. In respective embodiments, the same reference numerals are applied to the same components to omit or simplify description therefor.

First Embodiment

Figure 2:
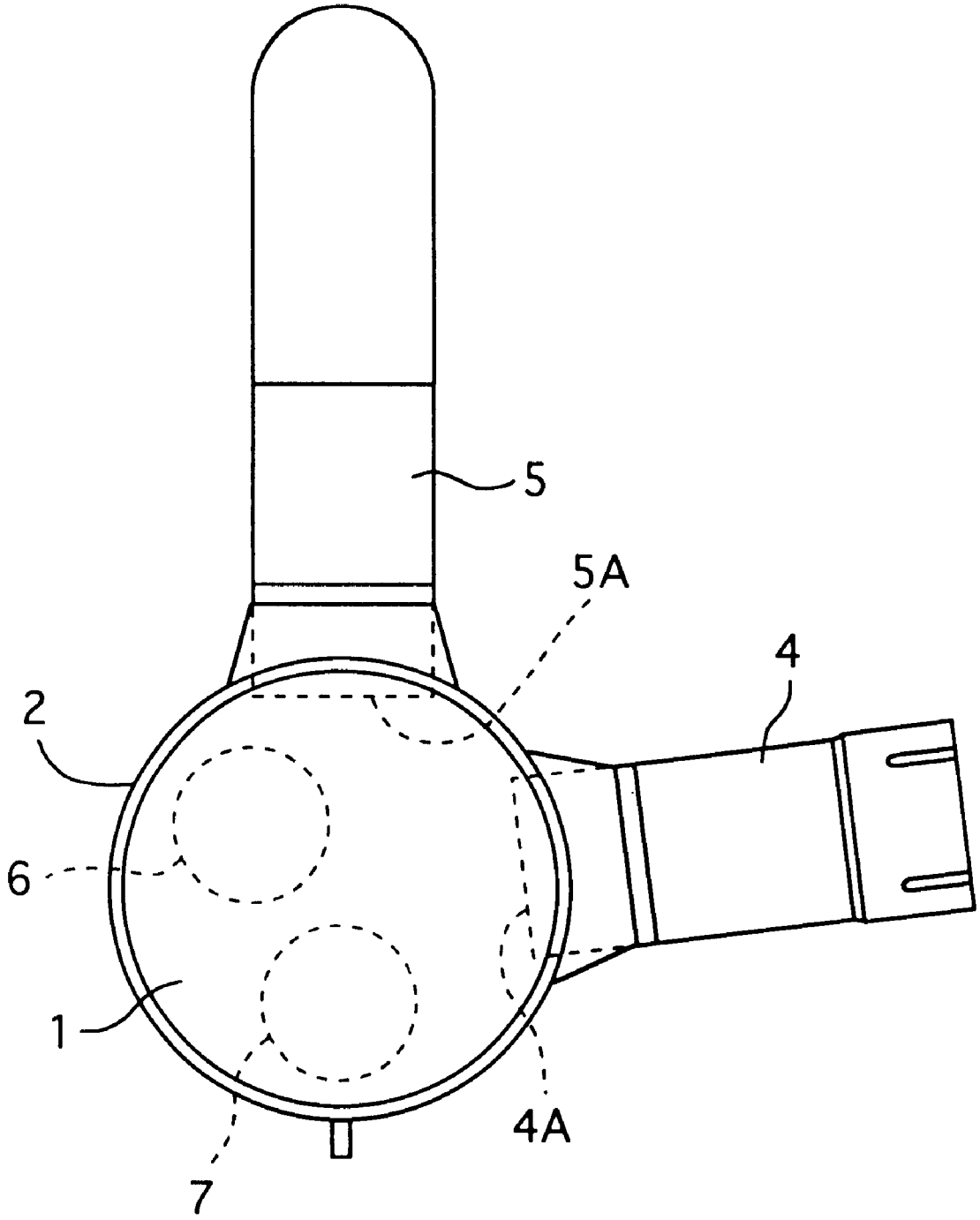
FIG. 2 is a side elevation of FIG. 1.

First embodiment of the present invention is shown in FIGS. 1 and 2.

In the figures, an exhaust silencer 10 of the first embodiment is connected to an exhaust pipe (not shown) of a diesel engine for construction equipment. The exhaust silencer 10 includes: a body 2 having a shape of both-end-bottomed cylinder having both ends being closed by end plates 1, i.e., drum-shape; first and second partitions 3A and 3B disposed parallel in an axial direction of the body 2 for partitioning the body 2 into first to third damping chambers 2A to 2C; an exhaust gas inlet pipe 4 in communication with the first damping chamber 2A and having the exhaust pipe connected thereto; a first damping chamber 2A and having the exhaust pipe connected thereto; a tail pipe 5 in communication with the third damping chamber 2C; first communicating pipe 6 with an intermediate portion being supported by the first partition 3A and an end being supported by the second partition 3B; and second communicating pipe 7 with an end being supported by the first partition 3A and an intermediate portion being supported by the second partition 3B.

The first and second partitions 3A and 3B respectively have a disk 3D, a peripheral portion 3E standing on a periphery of the disk 3D and abutting inner circumference of the body 2, and a support 3F for supporting the two communicating pipes 6 and 7 at a central portion of the disk 3D.

One peripheral portion 3E of the partitions 3A and 3B are secured to the inner circumference of the body 2 by welding etc, and the other peripheral portion 3E of the partitions 3A and 3B is press-fitted to the inner circumference of the body 2 movably in axial direction.

The exhaust gas inlet pipe 4 is secured by welding etc. to an outer circumference of the body 2 so that an axis thereof becomes orthogonal with axial direction of the body 2. An end portion open to first damping chamber 2A at the uppermost-stream side is an exhaust gas inlet 4A for introducing the exhaust gas generated by the diesel engine through a connecting pipe.

Incidentally, though the exhaust gas inlet 4 is depicted as being opposite (below in the figure, 180 degrees position) to the tail pipe 5 sandwiching the axis of the body 2, it is just for clarifying the relationship between the exhaust gas inlet pipe 4 and the first damping chamber 2A. In actual implementation, the tail pipe 5 may be attached in approximately 90 degrees position relative to the exhaust gas inlet pipe 4 around the axis of the body 2, as shown in FIG. 2.

The tail pipe 5 is fixed to the outer circumference of the body 2 so that an axis thereof becomes orthogonal with axial direction of the body 2. An end portion open to third damping chamber at the most lower-stream side is an exhaust gas outlet 5A for discharging the exhaust gas to the outside.

The first communicating pipe 6 is composed of a cylindrical member 8 having an axis parallel to the axial direction of the body 2 and an end plate 9 disposed on both ends of the cylindrical member 8.

An outer circumference of the cylindrical member 8 has a large number of communicating hole 8A1 to a portion facing the first damping chamber 2A, and another large number of communicating hole 8A2 to a portion facing the second damping chamber 2B. The number of the communicating holes 8A1 open to the first damping chamber 2A is less than the number of the communicating holes 8A2 open to the second damping chamber 2B. Accordingly, in the first communicating pipe 6, total opening area of the communicating holes 8A1 is less than total opening area of the communicating holes 8A2 open to the second damping chamber 2B. More specifically, the total area of the communicating holes 8A1 open to the first damping chamber 2A is smaller than cross sectional area of the first communicating pipe 6 and the total area of the communicating holes 8A2 open to the second damping chamber 2B is larger than cross sectional area of the first communicating pipe 6. The end plate 9 is not restricted to have completely closed structure, but may have semi-closed structure having communicating portion such as small holes as long as flow-in and flow-out of the exhaust gas from the communicating holes 8A on the outer circumference of the communicating pipe 6 can be substantially conducted. When the end plate 9 has the semi-closed structure, the end plate 9 disposed to the first damping chamber 2A may preferably have semi-closed structure for reducing flow resistance of the exhaust gas.

Similarly to the first communicating pipe 6 and 7, the second communicating pipe 7 has a cylindrical member 8 having an axis parallel to the axial direction of the body 2 and end plates 9 disposed to both ends of the cylindrical member 8.

On an outer circumference of the cylindrical member 8 of the second communicating pipe 7, a large number of communicating holes 8A3 is formed to a portion open to the second damping chamber 2B and another large number of communicating holes 8A4 is formed to a portion open to the third damping chamber 2C. The number of the communicating holes 8A3 open to the second damping chamber 2B is the same or less than the number of the communicating holes 8A4 open to the third damping chamber 2C. Accordingly, the total opening area of the communicating holes 8A3 open to the second damping chamber 2B of the second communicating pipe 7 is the same or less than the total opening area of the communicating holes 8A4 open to the third damping chamber 2C.

As in the first communicating pipe 6, the end plate 9 of the second communicating pipe 7 may have completely closed structure, or alternatively, semi-closed structure. However, semi-closed structure is preferable for the end plate 9 disposed to the third damping chamber 2C for reducing the resistance of the exhaust gas flow.

The first and second partitions 3A and 3B form a partitioning, which is not restricted to the completely closed structure but may have semi-closed structure having communicating portion such as small holes for bypassing a part of the exhaust gas as long as flow-in and flow-out of the exhaust gas from the communicating holes 8A1 to 8A4 on the outer circumference of the communicating pipes 6 and 7 can be substantially conducted.

The first damping chamber 2A is positioned uppermost-stream side and has volume ratio to volume of the entire damping chambers, i.e. total volume of the first to third damping chambers 2A to 2C, of 40 to 50%, which is the largest volume among the first to the third damping chambers 2A to 2C.

When the volume ratio of the first damping chamber 2A to the entire damping chambers is less than 40%, the exhaust noise damped when the exhaust gas flows from the exhaust gas inlet pipe 4 to be expanded in the first damping chamber 2A is reduced. On the other hand, when the volume ratio exceeds 50%, the size of the entire exhaust silencer 10 is made large on account of balance against the other damping chambers 2B and 2C, thus deteriorating damping effect relative to enlarged proportion of the silencer.

In other words, since a volume exceeding a predetermined amount is required for the other damping chambers 2B and 2C in accordance with flow velocity of the exhaust gas flowing into the exhaust gas inlet pipe 4, when the size of the first damping chamber 2A exceeds 50% of the total volume while retaining the volume, the size of the body 2 is increased, thus making the entire exhaust silencer 10 large.

The volume ratio of the second damping chamber 2B and the third damping chamber 2C may be arranged in any manner, that is, the volume of the second damping chamber 2B may be larger than the volume of the third damping chamber 2C, or may be smaller, or may be the same.

In order to construct the exhaust silencer 10, a sub-assembly of the first and the second partition 3A and 3B having the first communicating pipe 6 and the second communicating pipe 7 attached in advance is inserted to the inside of the body 2 with the side plate 1 being detached. With the end face of the body 2 is made open, the first and second partitions 3A and 3B are centered by fine adjustment relative to the body 2. Subsequently, one of the first and the second partitions 3A and 3B are fixed to the body 2 by welding etc. and the other is press-fitted to the body 2. Finally, both ends of the body 2 is closed by the end plate 1, the exhaust gas inlet pipe 4 and the tail pipe 5 are attached to outer circumference of the body 2, and the exhaust pipe of the diesel engine is connected to the exhaust gas inlet pipe 4.

Next, a function of the first embodiment will be described below.

The exhaust gas generated by the diesel engine is sent to the exhaust gas inlet pipe 4 through the exhaust pipe. The exhaust gas sent to the exhaust gas inlet pipe 4 is blown into the first damping chamber 2A positioned at the uppermost-stream side while being rapidly expanded, so that exhaust noise including low-frequency component is removed.

The exhaust gas sent to the first damping chamber 2A is transferred to the inside of the first communicating pipe 6 while being contracted by the communicating holes 8A1 of the first communicating pipe 6, during which the exhaust noise is damped. The second damping function is effected during the step where the exhaust gas enters the inside of the first communicating pipe 6 through the communicating holes 8A1 of the first communicating pipe 6.

The flow of the exhaust gas flowing into the inside of the first communicating pipe 6 in radial direction through the communicating holes 8A1 is straightened inside the pipe with a direction thereof being turned in an axial direction. After the flowing direction is changed to a right angle by the communicating holes 8A2 and the flow is straightened, the exhaust gas is sent to the second damping chamber 2B while being expanded to reduce pressure fluctuation of the exhaust gas.

The exhaust gas sent to the second damping chamber 2B is blown into the inside of the second communicating pipe 7 while being contracted by the communicating holes 8A3 of the second communicating pipe 7, during which the exhaust noise is damped.

The exhaust gas flowing into the inside of the second communicating pipe 7 from radial direction through the communicating holes 8A3 circulates inside the pipe by changing direction thereof in an axial direction, thereby reducing pressure fluctuation of the exhaust gas. Subsequently, after the flow of exhaust gas is straightened by the communicating holes 8A4 on the lower-stream side, the exhaust gas is sent to the third damping chamber positioned to the lowermost-stream side while being expanded, thus reducing pressure fluctuation of the exhaust gas.

The exhaust gas sent into the third damping chamber 2C is discharged to the outside through the tail pipe 5.

Incidentally, when the pressure fluctuation is reduced, diameter, size etc. of the communicating holes 8A1 to 8A4 of the communicating pipes 6 and 7 are defined so that the pressure loss of the exhaust gas caused when the flow turns in axial direction in the first communicating pipe 6, when the flow is discharged from the first communicating pipe 6 into the second communicating pipe 7, when the flow turns in axial direction in the second communicating pipe 7 and when the flow is discharged from the second communicating pipe 7 to the third damping chamber 2C, and becomes approximately equal to a value proportionally dividing the rest of the pressure loss caused on entering into the first and second communicating pipes 6 and 7.

According to the above-described first embodiment, following effects (1) to (10) can be obtained.

(1) Since the exhaust silencer 10 has the first to the third damping chambers 2A to 2C, the first damping chamber 2A positioned at the uppermost-stream having the exhaust gas introduction hole 4A for directly introducing the exhaust gas of the diesel engine, the exhaust gas introduced from the exhaust gas introduction hole 4A to the first damping chamber 2A expands to damp the exhaust noise. Further, since the first and the second communicating pipes 6 and 7 for intercommunicating adjacent spaces of the damping chambers 2A to 2C are provided, the communicating pipes 6 and 7 having end plates 9 on both side thereof and having a large number of communicating holes 8A1 to 8A4 to a predetermined position of the outer circumference corresponding to the chambers for intercommunication, the exhaust gas loses pressure thereof by experiencing repeated contraction and expansion by the communicating holes 8A1 to 8A4 of the communicating pipes 6 and 7 to damp energy thereof. Accordingly, the exhaust noise can be effectively damped.

In other words, since sufficient damping effect can be established with a comparatively small damping chamber, the size of the entire silencer can be reduced.

(2) Since the volume of the first damping chamber 2A located at the uppermost-stream side has the largest volume of 40 to 50% of total volume, the exhaust gas introduced from the exhaust gas introduction hole 4A to the first damping chamber 2A rapidly expands, thus enhancing damping effect of the exhaust noise including low-frequency component.

(3) Since the total opening area of the communicating hole 8A open to the upstream damping chambers 2A and 2B of the communicating pipes 6 and 7 is smaller than the total opening area of the communicating holes 8A open to the lower-stream damping chambers 2B and 2C, large exhaust noise reduction effect can be obtained, and the jet noise generated at the upstream side does not remain to the lower-stream side.

(4) Since the total area of the communicating holes 8A1 open to the first damping chamber 2A is smaller than the cross section of the first communicating pipe 6 and the total area of the communicating holes 8A2 open to the second damping chamber is larger than the cross section of the first communicating pipe 6, the flow velocity of the exhaust gas on the lower-stream side can be lowered to reduce the pressure loss and jet noise.

More specifically, since the exhaust gas flows in axial direction inside the first communicating pipe 6 and the communicating holes 8A1 and 8A2 are opened to be orthogonal with the flow, the flow velocity on lower-stream side can be excessive when the total area of the lower-stream communicating holes 8A2 is less than the cross section of the communicating pipe 6. Since the pressure loss is affected by a square of the flow velocity and is also affected by whether the flow is inside the communicating pipe 6 or passing the communicating holes 8A2, the pressure loss is caused when the total area of the lower-stream communicating holes 8A2 is not larger than the cross section of the communicating pipe 6 to increase jet noise.

(5) Since the communicating holes 8A is formed so that the pressure loss of the exhaust gas is the largest at the entrance of the first communicating pipe 6 (one third to half of the entire pressure loss), the pressure loss can be effectively generated at the upstream side having the largest energy of the exhaust gas, thereby obtaining great damping effect.

(6) When the end plates 9 on both ends of the communicating pipes 6 and 7 has semi-closed structure by forming small holes, the pressure loss can be reduced by using the small holes provided to the end plates 9 as an aid for the communicating holes 8A.

(7) When a part of the exhaust gas is bypassed by forming small holes to the partitions 3A and 3B as partitioning, the small holes provided to the partitions 3A and 3B can be used as an aid of the communicating holes 8A1 to 8A4 formed on the communicating pipes 6 and 7 to reduce pressure loss.

(8) Since two partitions 3A and 3B are used for forming the three damping chambers and positioning of the two partitions 3A and 3B to the inner circumference of the body 2 is easy, assembly work can be easily conducted. On the other hand, in order to assemble the conventional exhaust silencer 100, the communicating pipe 53 attached with the partitions 52B to 52C are mounted to a cylindrical inner circumference of the drum-shaped body 51. At this time, the position of the partitions 52A to 52C has to be determined by moving in an axial direction of the body 51 and position adjustment of the partition 52A and the communicating pipe 53 is difficult, thus complicating assembly work of the silencer.

(9) For constructing the exhaust silencer 10, the first communicating pipe 6 and the second communicating pipe 7 are secured to the first and the second partitions 3A and 3B to be one component (sub-assembly), which is attached to the inside of the body 2. Subsequently, the first and the second partitions 3A and 3B are finely adjusted in axial direction for defining position thereof. Accordingly, the assembly work can be easily and accurately conducted.

(10) Since one of the first and the second partitions 3A and 3B is fixed to the body 2 by welding etc. and the other is press-fitted, when the communicating pipes 6 and 7 are expanded by a heat of the exhaust gas, the thermal expansion of the communicating pipes 6 and 7 can be absorbed by relative movement of the press-fitted partitions 3A and 3B against the body 2.

Incidentally, following arrangement is possible as a modification of the first embodiment.

The first damping chamber 2A is the damping chamber having the largest volume in FIG. 1. However, in the first embodiment, as long as the total area of the communicating holes 8A1 of the first communicating pipe 6 is smaller than the total area of the other communicating holes 8A2 to 8A4, the volume of the chamber having the communicating holes 8A2 opening directly after the first communicating pipe 6 with the communicating holes 8A1 having the smallest opening area, i.e. second damping chamber 2B, may be the largest.

According to the above arrangement, the same effects (1) and (3) to (10) as the first embodiment can be obtained, and following effect similar to the effect (2) can be obtained.

(2') Since the volume of the second damping chamber 2B in direct communication with the communicating pipe 6 having the communicating holes 8A1 with the minimum total opening area is the largest through the communicating pipe 8A2, the exhaust gas contracted to the minimum by the communicating holes 8A1 with minimum total opening area is rapidly expanded by being introduced to the second damping chamber 2B having the largest volume, thereby enhancing the damping effect of the exhaust gas including low-frequency component.

Such modification of the damping chamber having the largest volume can be respectively applied to each following embodiment.

Second Embodiment

Next, second embodiment of the present invention will be described below with reference to FIG. 3.

The second embodiment differs from the first embodiment in that the communicating pipe is a single continuous communicating pipe, and the rest basic arrangement is the same as the first embodiment.

Figure 3:
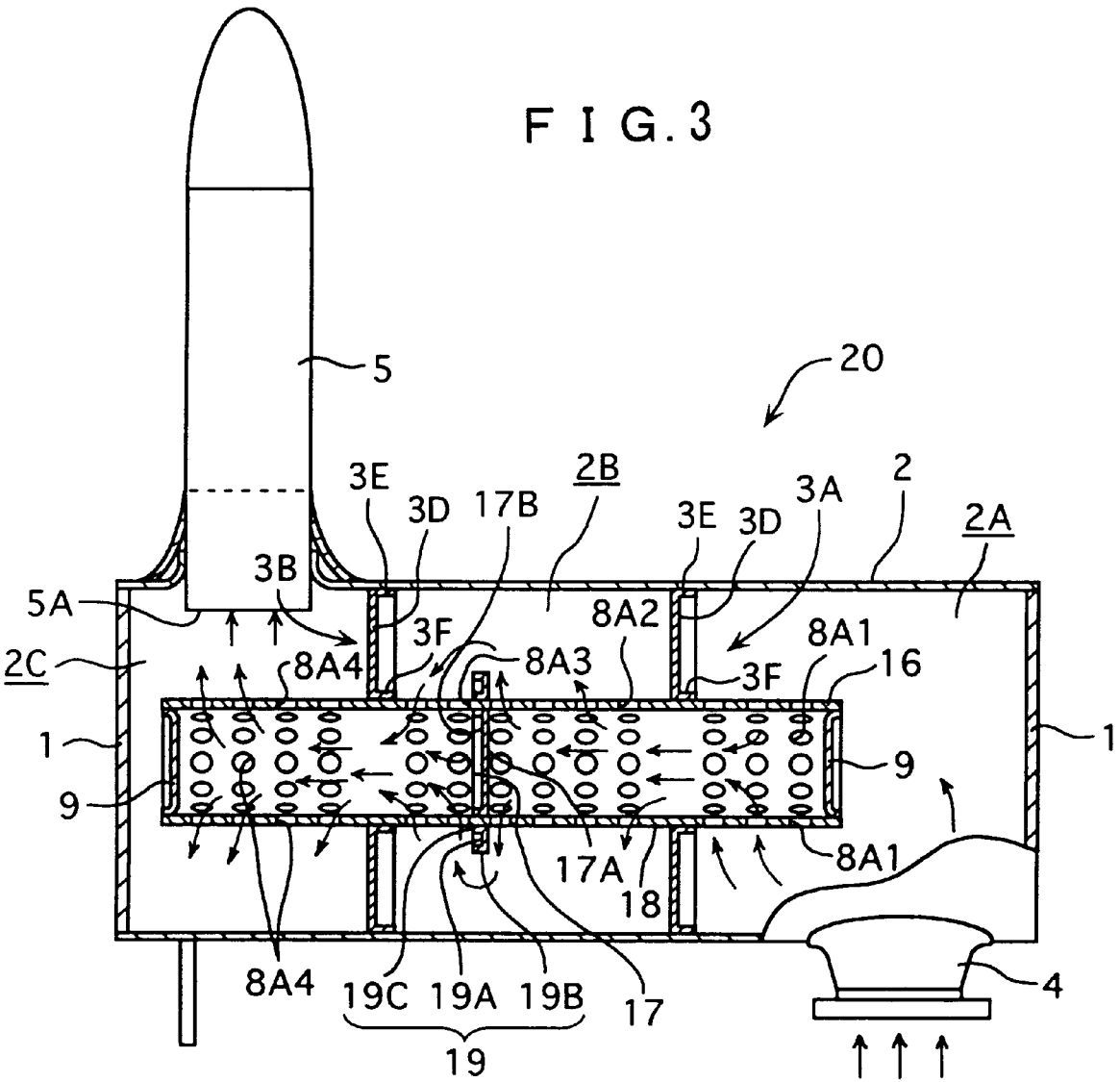
FIG. 3 is a cross section showing entire structure of an exhaust silencer according to a second embodiment of the present invention.

In FIG. 3 showing entire structure, the exhaust silencer 20 of the second embodiment has a drum-shaped body 2, first and second partitions 3A and 3B for partitioning the body 2 into the first to third damping chamber 2A to 2C, an exhaust gas inlet pipe 4 provided to the body 2, a tail pipe 5 provided to the body 2, a communicating pipe 16 supported by the first partition 3A and the second partition 3B respectively, a cutoff partition 17 provided to an axially intermediate position of the communicating pipe 16 corresponding to intermediary of the second damping chamber 2B, and a partitioning wall 19 provided to an outer circumference of the cutoff partition 17.

The communicating pipe 16 is composed of a cylindrical member 18 having an axis parallel to the axial direction of the body 2, and end plates 9 provided to both ends of the cylindrical member 18. The end plate 9 and the partitions 3A and 3B may be completely closed or semi-closed as in the first embodiment.

A large number of communicating holes 8A1 and 8A2 are formed to the outer circumference of the cylindrical member 18 on a portion facing the first damping chamber 2A and the second damping chamber 2B respectively on upstream side relative to the cutoff partition 17 of the communicating pipe 16. The number of the communicating holes 8A1 open to the first damping chamber 2A is smaller than the number of the communicating holes 8A2 open to the second damping chamber 2B. Accordingly, the total opening area of the communicating holes 8A1 open to the first damping chamber 2A is smaller than the total opening area of the communicating holes 8A2 open to the second damping chamber 2B.

A large number of communicating holes 8A3 and 8A4 having the same configuration are respectively formed to the outer circumference of the cylindrical member 18 on a position facing the second damping chamber 2B and the third damping chamber 2C on lower-stream side relative to the cutoff partition 17 of the communicating pipe 16. The number of the communicating holes 8A3 open to the second damping chamber 2B is the same as or smaller than the communicating holes 8A4 open to the third damping chamber 2C. Accordingly, the total opening area of the communicating holes 8A3 open to the second damping chamber 2B is the same as or smaller than the total opening area of the communicating holes 8A4 open to the third damping chamber 2C.

The cutoff partition 17 is configured in an approximate dish-shape with a peripheral portion 17B abutting inner circumferential surface of the communicating pipe 16 and standing on a periphery of a disk member 17A.

The cutoff partition 17 is provided for using the single communicating pipe 16 as two communicating pipes, in which upstream portion relative to the cutoff partition 17 corresponds to the first communicating pipe 6 of the first embodiment and the lower-stream portion relative to the cutoff partition 17 corresponds to the second communicating pipe 7 of the first embodiment.

The partitioning wall 19 is provided coplanarly to the cutoff partition 17 and includes a ring-shaped member 19A facing the second damping chamber 2B, a peripheral portion 19B standing on a periphery of the ring-shaped member 19A, and a support 19C for supporting the communicating pipe 16 at the center of the ring-shaped member 19A.

Next, an effect of the second embodiment will be described below.

In the second embodiment, the pressure fluctuation component of the exhaust noise is reduced when the exhaust gas sent to the exhaust gas inlet pipe 4 is blown into the first damping chamber 2A on the uppermost-stream side while being rapidly expanded, as in the first embodiment.

The exhaust gas blown into the first damping chamber 2A is sent to an inside of the communication pipe 16 while being contracted by the communicating holes 8A1 of the communicating pipe 16, during which sound of the exhaust gas is damped. The pressure fluctuation component is reduced to damp the sound by energy consumption of the exhaust gas (pressure loss) in the following respective portions, which is the same as the first embodiment.

The exhaust gas flown into the inside of the communicating pipe 16 from radial direction through the communicating holes 8A loses pressure thereof by being circulated in axial direction inside the pipe. Subsequently, after the flow of the exhaust gas is straightened by the communicating holes 8A in upstream side of the cutoff partition 17, the exhaust gas is expanded and sent to the second damping chamber 2B, thereby reducing pressure fluctuation of the exhaust gas to damp the sound thereof. The exhaust gas sent from the upstream side of the cutoff partition 17 to the second damping chamber 2B flows into the lower-stream communicating holes 8A bypassing the partitioning wall 19 while being contracted. Since the exhaust gas thus detours, the exhaust gas flows to the lower-stream side of the partitioning wall 19 just like via another damping chamber (expansion chamber), thus damping the sound thereof and also damping the sound through the contracting step by the communicating holes 8A.

The pressure fluctuation of the exhaust gas blown into the inside of the communicating pipe 16 through the communicating holes 8A from radial direction is reduced by being circulated in axial direction in the pipe. Subsequently, on the lower-stream side, after the flow of the exhaust gas is straightened by the communicating holes 8A, the pressure fluctuation of the exhaust gas is further reduced by being expanded and sent to the third damping chamber 2C located at the lowermost-stream side. The exhaust gas sent into the third damping chamber 2C is discharged to the outside through the tail pipe 5.

According to the second embodiment, in addition to the effects (1) to (10) of the first embodiment, following effects can be obtained.

(11) Since the entire communicating pipe 16 is composed of a single continuous communicating pipe and the communicating pipe cutoff partition 17 is formed on an approximate center of the second damping chamber 2B other than the first damping chamber 2A on the uppermost-stream side and the third damping chamber 2C on the lowermost-stream side, a plurality of communicating pipe is not required to be disposed parallel in radial direction in the same damping chamber, thus reducing the size of the exhaust silencer

(12) Since the partitioning wall 19 for partitioning a part of the second damping chamber 2B is provided to the outer circumference of the cutoff partition 17, the exhaust gas discharged from the communicating holes 8A on the upstream side of the cutoff partition 17 flows into the communicating holes 8A on the lower-stream side bypassing the partitioning wall 19, the second damping chamber 2B can function just like two damping chambers by the partitioning wall 19, thus enhancing damping effect.

[Third Embodiment]

Next, third embodiment of the present invention will be described below with reference to FIG. 4.

The third embodiment is a variation of the second embodiment.

Figure 4:
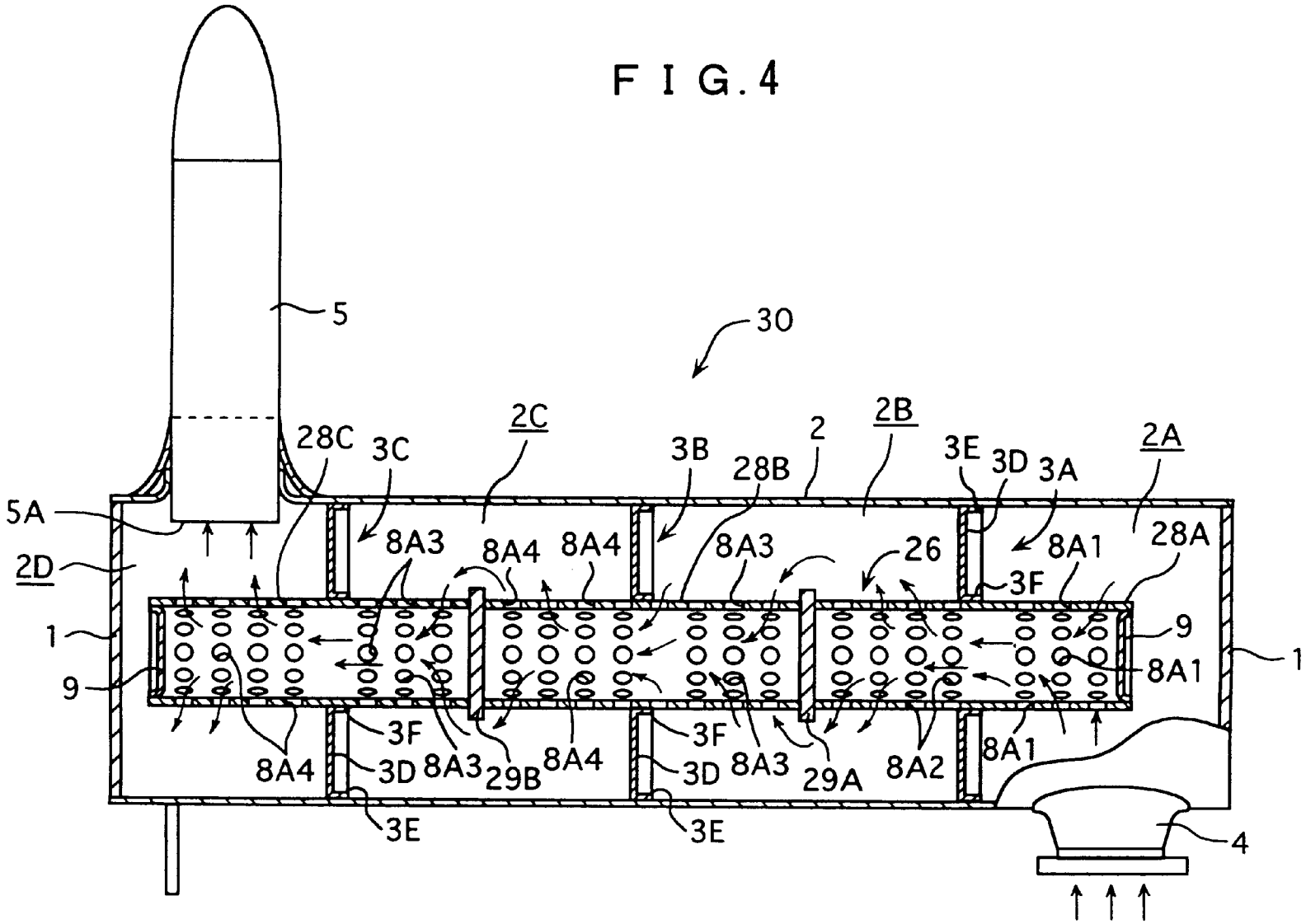
FIG. 4 is a cross section showing entire structure of an exhaust silencer according to third embodiment of the present invention.

In FIG. 4 showing the entire structure, the exhaust silencer 30 of the third embodiment has a body 2 divided into first to fourth damping chambers 2A to 2D by first to third partitions 3A to 3C, a substantially single communicating pipe 26 supported by the partitions 3A to 3C, and first and second partitioning member 29A and 29B.

The third partition 3C has the same structure as the first and the second partitions 3A and 3B.

The communicating pipe 26 has first to third cylindrical member 28A to 28C, an end plate 9 disposed to one end of the first cylindrical member 28A and the third cylindrical member 28C. The first partitioning member 29A is inserted between the other end of the first cylindrical member 28A and one end of the second cylindrical member 28B, and the second partitioning member 29B is inserted between the other end of the second cylindrical member and the other end of the cylindrical member 28C.

The partitioning members 29A and 29B are secured to the end surface of the cylindrical members 28A to 28C by welding etc, of which peripheral portion larger than the cross section of the cylindrical members 28A to 28C works as the partitioning wall 19 of the second embodiment.

The function of the third embodiment is the same as the second embodiment.

In the third embodiment, in addition to the effects (1) to (7), (9), (11) and (12) of the second embodiment, following effects can be obtained.

(13) Since the four damping chambers, i.e. the first to the fourth damping chambers 2A to 2D, are provided, damping effect can be improved.

(14) Since the communicating pipe cutoff partition and each of the partitioning wall are formed by one partitioning member 29A and 29B, the number of parts can be decreased and manufacture thereof can be facilitated thereby reducing production cost.

[Fourth Embodiment]

Next, the fourth embodiment of the present invention will be described below with reference to FIG. 5.

The fourth embodiment differs from the first to third embodiments in lower-stream end configuration of the communicating pipe, and the rest of the basic arrangement is the same as the first to third embodiments.

Figure 5:
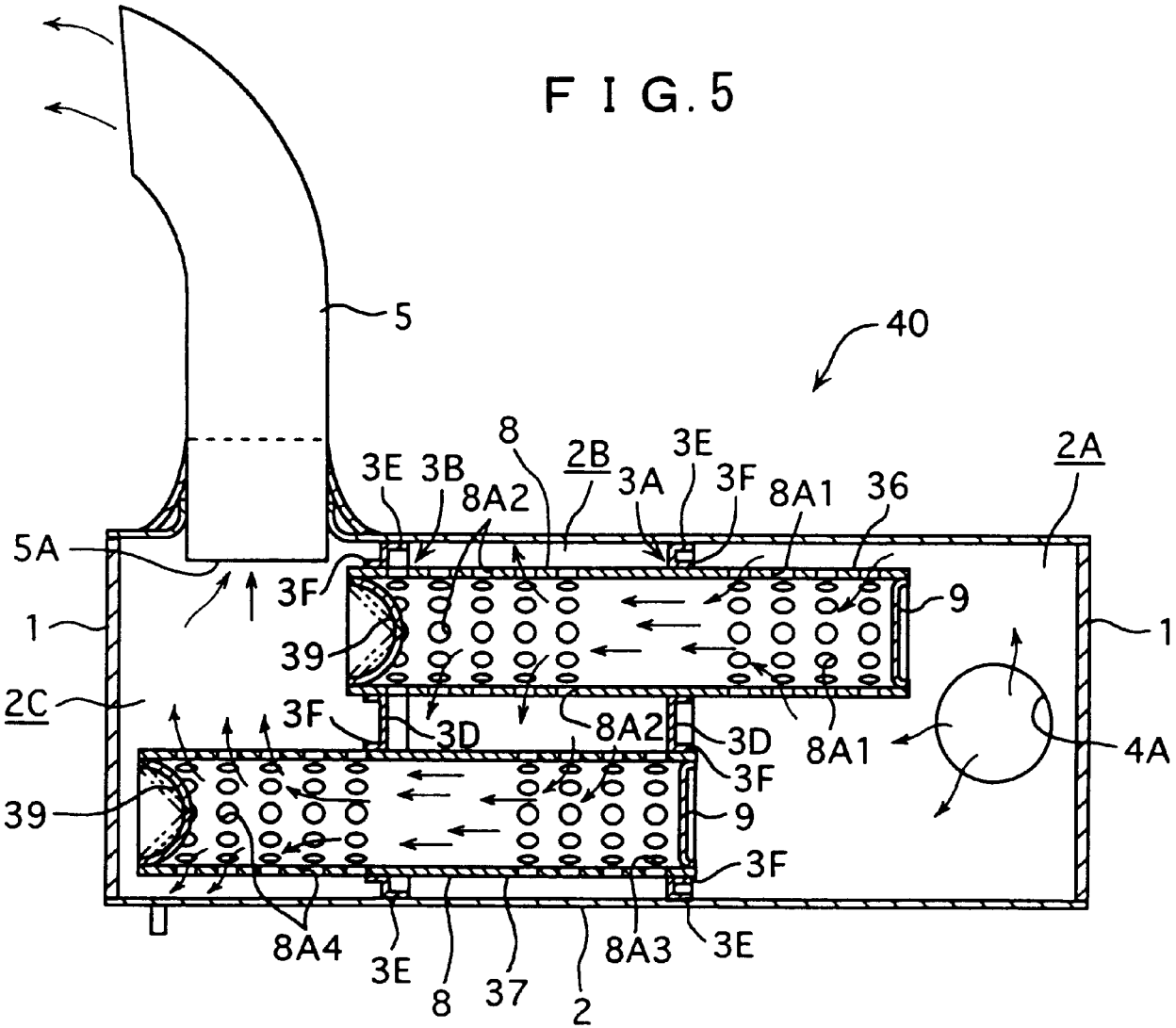
FIG. 5 is a cross section showing entire structure of an exhaust silencer according to fourth embodiment of the present invention.

In FIG. 5 showing the entire structure, the exhaust silencer 40 of the fourth embodiment has a drum-shaped body 2, the first and the second partitions 3A and 3B for dividing the body 2 into the first to the third damping chambers 2A to 2C, the exhaust gas inlet pipe 4 provided to the body 2, the tail pipe 5 provided to the body 2, first communicating pipe 36 with an intermediate portion supported by the first partition 3A and the intermediate portion supported by the second partition 3B.

The first communicating pipe 36 includes the cylindrical member 8 having a large number of the communicating holes 8A, an end plate 9 provided to the upstream side end of the cylindrical member 8, and a hollow plate 39 provided to lower-stream side of the cylindrical member 8 as a partition.

The hollow plate 39 is dented to inside of the first communicating pipe 36, of which configuration may be spherical as shown in solid line in FIG. 5, or may be conic as shown is fictitious line of FIG. 5.

The second communicating pipe 37 has the same structure as the first communicating pipe 36, which includes the cylindrical member 8 having a large number of communicating holes 8A, an end plate 9 provided to upstream end portion of the cylindrical member 8, and a hollow plate 39 provided to upstream end portion of the cylindrical member 8, and a hollow plate 39 provided to the lower-stream side of the cylindrical member 8 as a partition.

Next, an effect of the fourth embodiment will be described below.

in the fourth embodiment, as in the first embodiment, the pressure fluctuation component of the exhaust noise is reduced when the exhaust gas send to the exhaust gas inlet pipe 4 is sent into the first damping chamber 2A positioned to the uppermost stream side while rapidly expanding.

The exhaust gas blown into the first damping chamber 2A flows into the inside of the pipe while being contracted by the communicating holes 8A of the first communicating pipe 36, during which the sound of the exhaust gas is damped.

The exhaust gas flowed into the inside of the first communicating pipe 36 from radial direction through the communicating holes 8A decreases pressure fluctuation thereof by being circulated in axial direction inside the pipe and further flows toward the hollow plate 39.

Conventionally, since the exhaust gas flowing in the communicating pipe in axial direction flows out of the communicating holes adjacent to the partition by being bumped into the partition, in observing velocity distribution and outflow distribution of the exhaust gas flowing out of the communicating holes of the communicating pipe, the velocity distribution or the outflow distribution adjacent to the partition is larger and becomes smaller as being separated from the partition. On the other hand, in the fourth embodiment, the exhaust gas flowing toward the hollow plate 39 is contracted by the hollow plate 39, and is expanded and sent to the second damping chamber 2B after being leveled by the communicating holes 8A of the second communicating holes 37. The exhaust gas flowed into the second communicating pipe 37 circulates in axial direction inside the pipe, which is contracted by the hollow plate 39 to be leveled by the communicating holes 8A and sent to the third damping chamber 2C while being expanded. Subsequently, as in the first embodiment, the exhaust gas is discharged to the outside from the third damping chamber 2C through the tail pipe 5.

According to the fourth embodiment, following effects van be obtained as well as effects (1) to (10) of the first embodiment.

(15) Since the lower-stream partition of the first and the second communicating pipes 36 and 37 is the hollow plate 39 dented to the inside, the exhaust gas sent in the axial direction inside the communicating pipe can be more easily flowed in radial direction by the partition formed of the hollow plate 39. Accordingly, the exhaust gas can be more easily flowed out in the axial direction from the communicating holes 8A, thereby reducing the jet noise generated in the communicating pipe.

[Fifth Embodiment]

Figure 6:
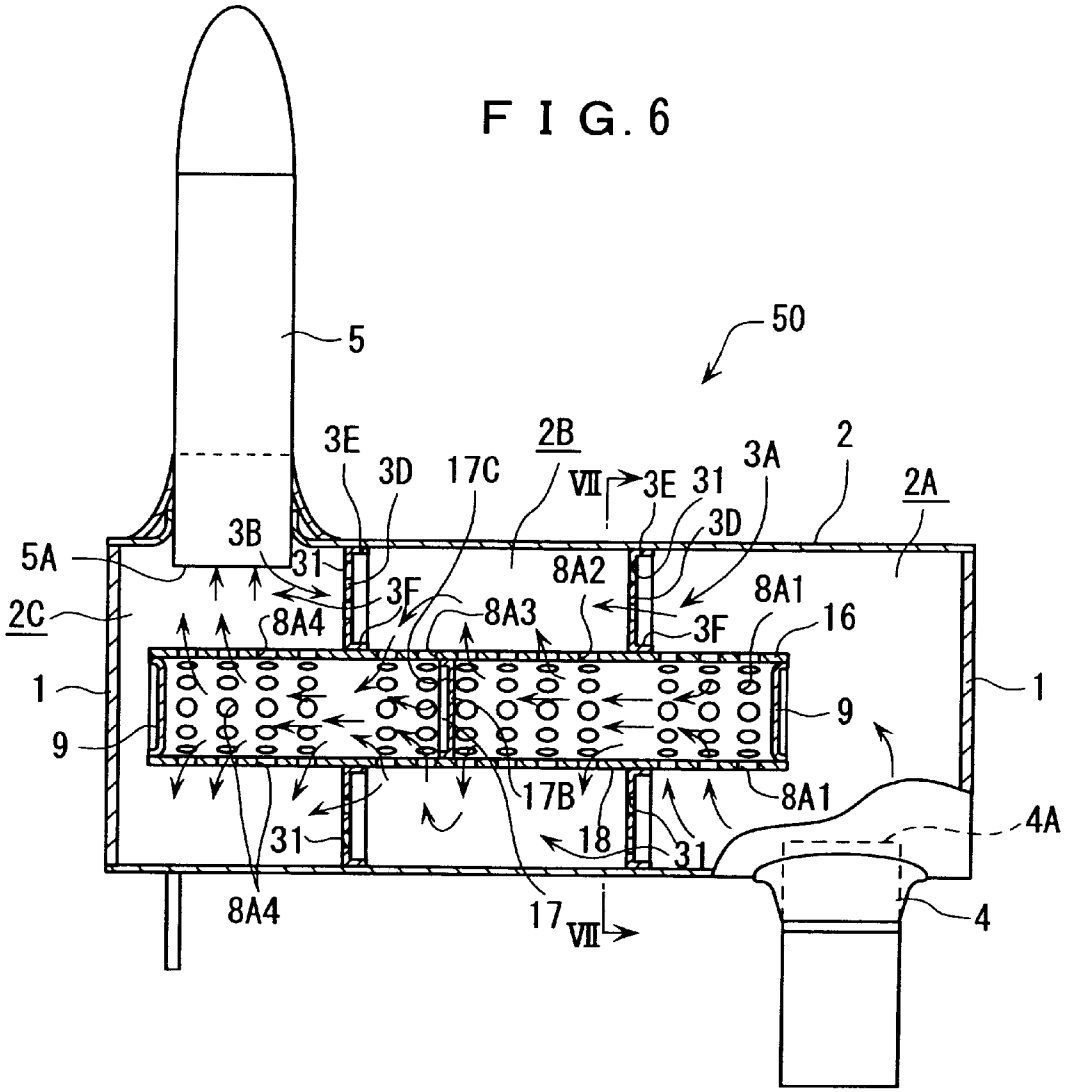
FIG. 6 is a cross section showing entire structure of an exhaust silencer according to fifth embodiment of the present invention.

In FIG. 6, a basic arrangement of exhaust silencer 50 of the fifth embodiment is the same as the above-described second embodiment. Accordingly, the same reference numeral is attached to the common components to omit description therefor. Components peculiar to the present embodiment will be described below.

In FIG. 6, a disk 3D of the first and second partitions 3A and 3B has a plurality of small hole 31 as a communicating portion.

Figure 7:
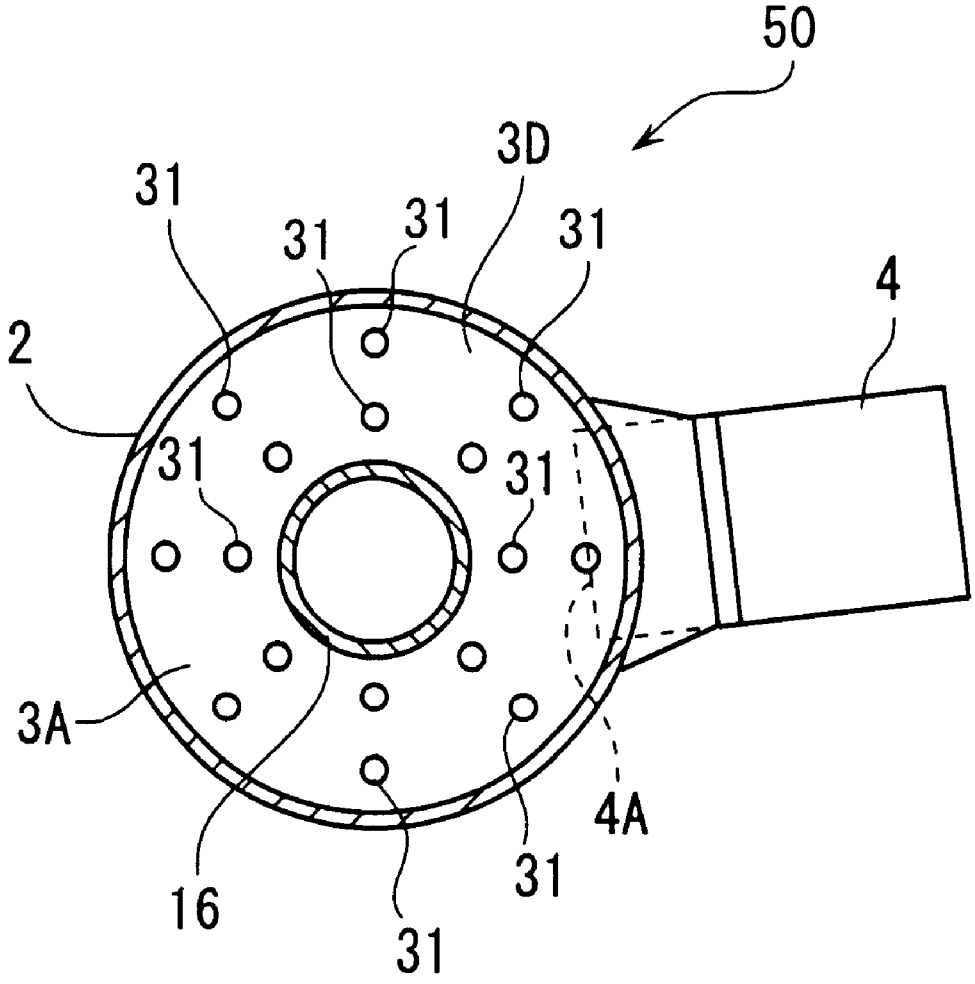
FIG. 7 is a cross section taken along VII—VII line in FIG. 6 viewed in allow-indicating direction.

As shown in FIG. 7, the small holes 31 are disposed around the communicating pipe 16 being spaced apart at a predetermined interval with each other.

In the fifth embodiment, a main flow path for circulating a majority of the exhaust gas is formed by the first damping chamber 2A, the communicating holes 8A1, inside of the communicating pipe 16, the communicating holes 8A2, the second damping chamber 2B, the communicating holes 8A3, inside of the communicating pipe 16, the communicating holes 8A4 and the third damping chamber 2C. And a by-path flow path for constantly circulating a part of the exhaust gas is formed by the small holes 31 formed on the partitions 3A and 3B.

Cross section (opening area) of the by-path flow path is arranged so that the amount of the exhaust gas circulating therein is 5 to 30%, more preferably, 10 to 20% of the exhaust gas flowing the inside of the entire silencer.

In other words, the total opening area of the small holes 31 on the first partition 3A constituting the by-path flow path is 5 to 30%, more preferably, 10 to 20% of the sum of the total area of the small holes 31 and total opening area of the communicating holes 8A1 constituting the main flow path.

In the same manner, the total opening area of the small holes 31 on the second partition 3B constituting the by-path flow path is 5 to 30%, more preferably, 10 to 20% of the sum of the total area of the small holes 31 and total opening area of the communicating holes 8A3 structuring the main flow path.

When the amount of the exhaust gas is less than 5% of the exhaust gas circulating inside the entire silencer, the pressure loss of exhaust gas increases to raise backpressure, which can result in black smoke. On the other hand, when the amount of the exhaust gas exceeds 30% of the exhaust gas circulating inside the entire silencer, sufficient damping effect cannot be obtained.

Figure 8A:
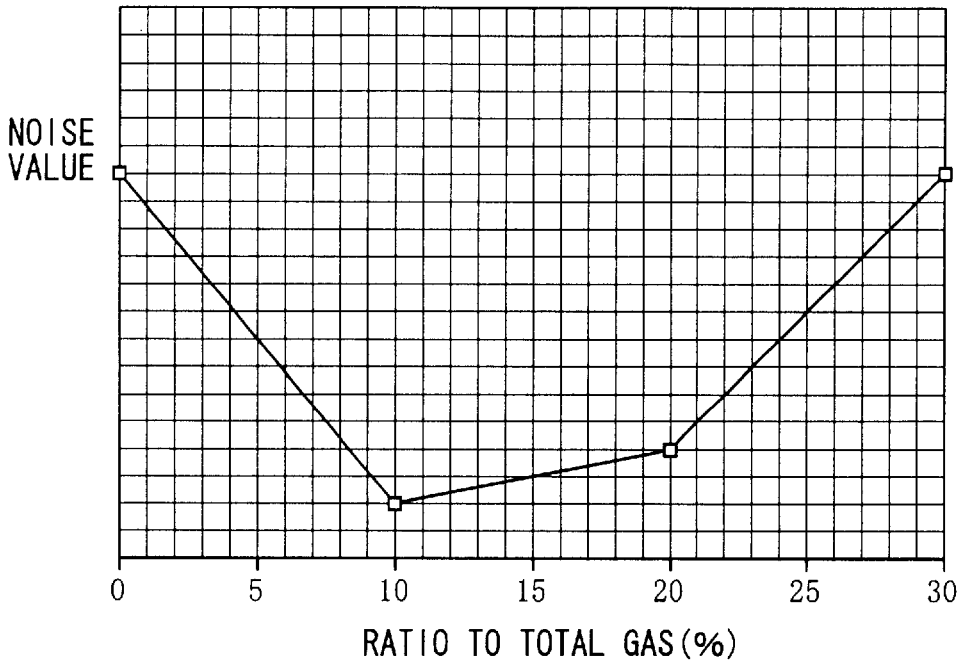
FIG. 8(A) is a graph showing a relationship between ratio to total gas and noise value.

That 10 to 20% value is preferable for the ratio of the exhaust gas circulating in the by-path flow path to the total gas amount (the exhaust gas amount circulating in the entire silencer) will be described based on a graph of FIG. 8(A) to 8(D). FIG. 8(A) is a graph showing relationship between noise value and a ratio of the exhaust gas of the by-path flow path to the total gas amount, and FIG. 8(B) is a graph showing relationship between exhaust resistance and a ratio of the exhaust gas of the by-path flow path relative to the total gas amount.

Figure 8B:
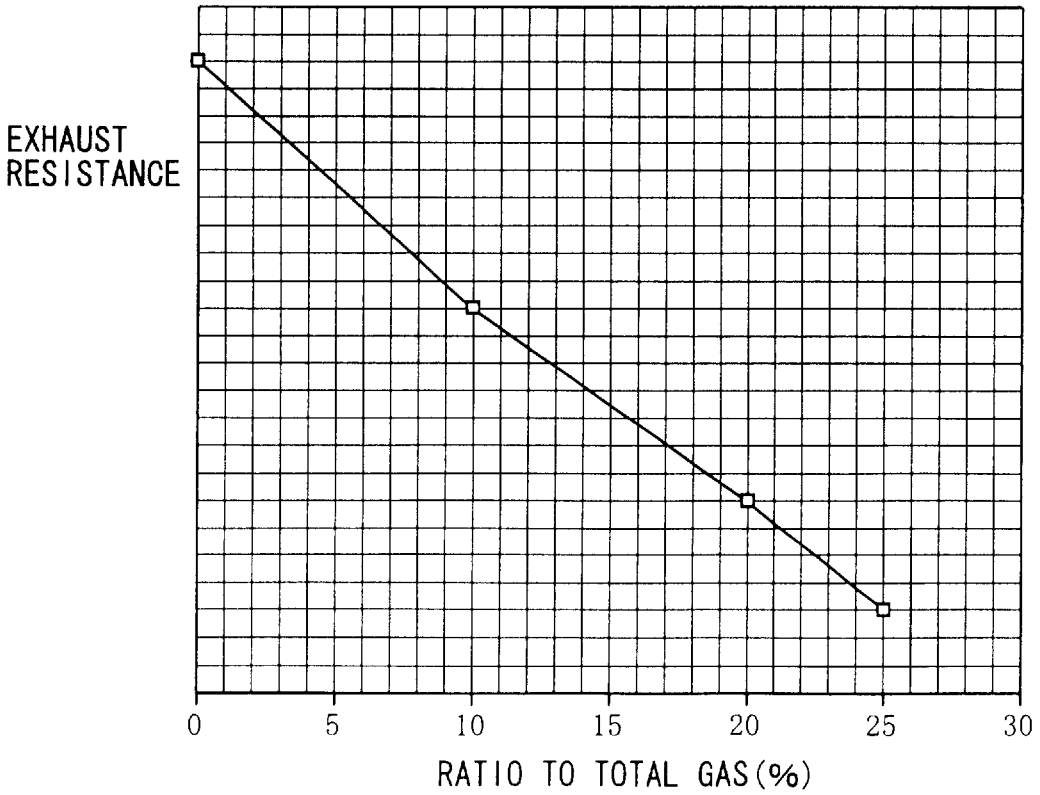
FIG. 8(B) is a graph showing a relationship between ratio to total gas and exhaust resistance.

As shown in FIG. 8(B), the exhaust resistance in inverse proportion to increase in the ratio to the total gas amount. However, as shown in FIG. 8(A), the noise value decreases as the ratio to the total gas amount increases from 0 to 10%, which remains within low level up to 20% and rapidly increases exceeding 20%.

Next, a function of the fifth embodiment will be described below.

The exhaust gas generated by the diesel engine flows into the exhaust gas inlet pipe 4 through the exhaust pipe. The exhaust noise including low-frequency component is removed from the exhaust gas flowed into the exhaust gas inlet pipe 4 when the exhaust gas is blown into the first damping chamber 2A located on the uppermost-stream side while being rapidly expanded.

Majority of the exhaust gas flowing into the first damping chamber 2A passes the main flow path and the rest passes the small holes 31 constituting the by-path flow path.

In other words, the majority of the exhaust gas flows into the inside of the communicating pipe 16 by being contracted by the communicating holes 8A1 of the communicating pipe 16. The sound of the exhaust gas flowed into the inside of the communicating pipe 16 is damped during the contraction process by the communicating holes 8A1. Subsequently, the flow of the exhaust gas is straightened with flow direction thereof being changed in the pipe after flowing into the inside of the communication pipe 16 and, on lower-stream side, the exhaust gas again turns direction thereof in a right angle by the communicating holes 8A2 to straighten the flow thereof, which is discharged to the second damping chamber 2B while being expanded. Accordingly, the pressure fluctuation of the exhaust gas is reduced.

In the second damping chamber 2B, the exhaust gas passing the small holes 31 of the first partition 3A joins with the exhaust gas passing the main flow path. Though the damping effect of the exhaust gas passing the small holes 31 is not so high of itself, the exhaust noise of the main flow path and the by-path flow path mutually interferes, thus being damped.

The majority of the exhaust gas flowed into the second damping chamber 2B is contracted by the communicating holes 8A3 on the lower-stream side to flow into the pipe for damping sound thereof. Subsequently, the exhaust gas circulates in the pipe turning direction thereof in the axial direction to reduce pressure fluctuation of the exhaust gas. After the flow of the exhaust gas is further straightened by the communicating holes 8A4, the exhaust gas flows out into the third damping chamber 2C located at the lowermost-stream side while being expanded, thus reducing pressure fluctuation of the exhaust gas.

On the other hand, the rest of the exhaust gas flows into the third damping chamber 3C through the small holes 31 of the second partition 3B to be joined with the exhaust gas passing the main flow path in the third damping chamber 3C to be interfered with each other for damping sound thereof.

The exhaust gas flowed into the third damping chamber 2C is discharged to the outside through the tail pipe 5.

According to the fifth embodiment, following effects can be obtained.

(16) Since a part of the exhaust gas discharged from internal combustion engine circulates in the by-path flow path as well as the main flow path, the loss by the exhaust pressure applied to the main flow path can be prevented from being too high.

(17) Since the exhaust gas is divided to flow in the main flow path and the by-path flow path and is joined thereafter, the exhaust noise (sound wave) mutually interferes with each other and is damped, thereby reducing exhaust noise.

(18) By setting the amount of the exhaust gas on the by-path flow path at the most appropriate value, the effect of the present embodiment can be more securely achieved.

(19) Since the exhaust silencer is composed of the damping chamber, the partition and the communicating pipe, the partition having holes constituting the by-path flow path, the size of the entire silencer can be reduced.

(20) Since the exhaust silencer 50 includes the first to third damping chambers 2A to 2C, the first damping chamber 2A at the uppermost-stream side having the exhaust gas introduction hole 4A for directly introducing the exhaust gas of the diesel engine, the exhaust gas introduced from the exhaust gas introduction hole 4A to the first damping chamber 2A is expanded to damp the exhaust noise.

(21) Since the communicating pipe 16 in communication with the damping chambers 2A to 2C are provided and the communicating pipe 16 has the end plates 9 on both sides, and since a large number of communicating holes 8A1 to 8A4 are provided at a predetermined position on the outer circumference corresponding to the chambers to be intercommunicated, the exhaust gas loses pressure after experiencing repeated contraction and expansion by the communicating holes 8A1 to 8A4 of the communicating pipe 16 to damp energy thereof when the exhaust gas is sent into the mutually adjacent damping chambers 2A to 2C. Accordingly, the exhaust noise can be effectively damped.

In other words, since sufficient damping effect can be obtained with relatively small damping chamber, the size of the entire silencer can be reduced.

(22) Since two partitions 3A and 3B are used for forming three damping chambers, positioning of the partitions 3A and 3B relative to inner circumference of the body 2 is facilitated, thereby easily conducting assembly work.

(23) Since the communicating pipe 16 is formed by a single consecutive communicating pipe and the communicating pipe cutoff partition 17 is formed on an approximate center of the second damping chamber 2B other than the first damping chamber 2A on the uppermost-stream and the third damping chamber 2C on the lowermost-stream, a plurality of communicating pipe is not required to be disposed in parallel in the same damping chamber, thus reducing size of the exhaust silencer 50.

[Sixth Embodiment]

Next, sixth embodiment of the present invention will be described below with reference to FIGS. 9 and 10.

Figure 9:
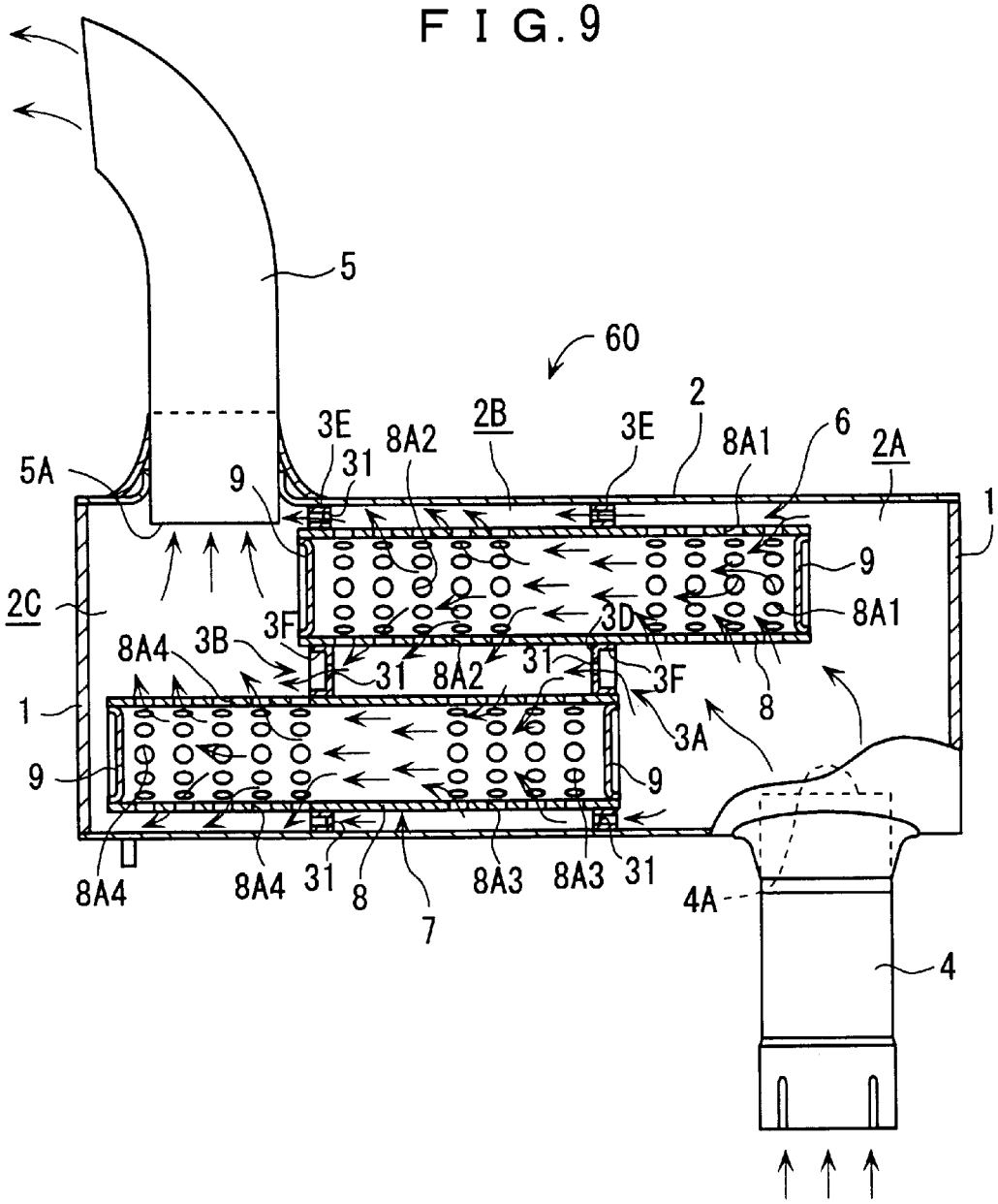
FIG. 9 is a cross section showing entire structure of an exhaust silencer according to sixth embodiment of the present invention.

In FIG. 9, an exhaust silencer 60 of the sixth embodiment has the same basic arrangement as the above-described first embodiment and the same reference numerals are used to the same components to omit description therefor. Portions peculiar to the present embodiment will be described below.

In FIG. 9, a disk 3D of the first and the second partition 3A and 3B has a plurality of the small holes 31 as in the fifth embodiment.

Figure 10:
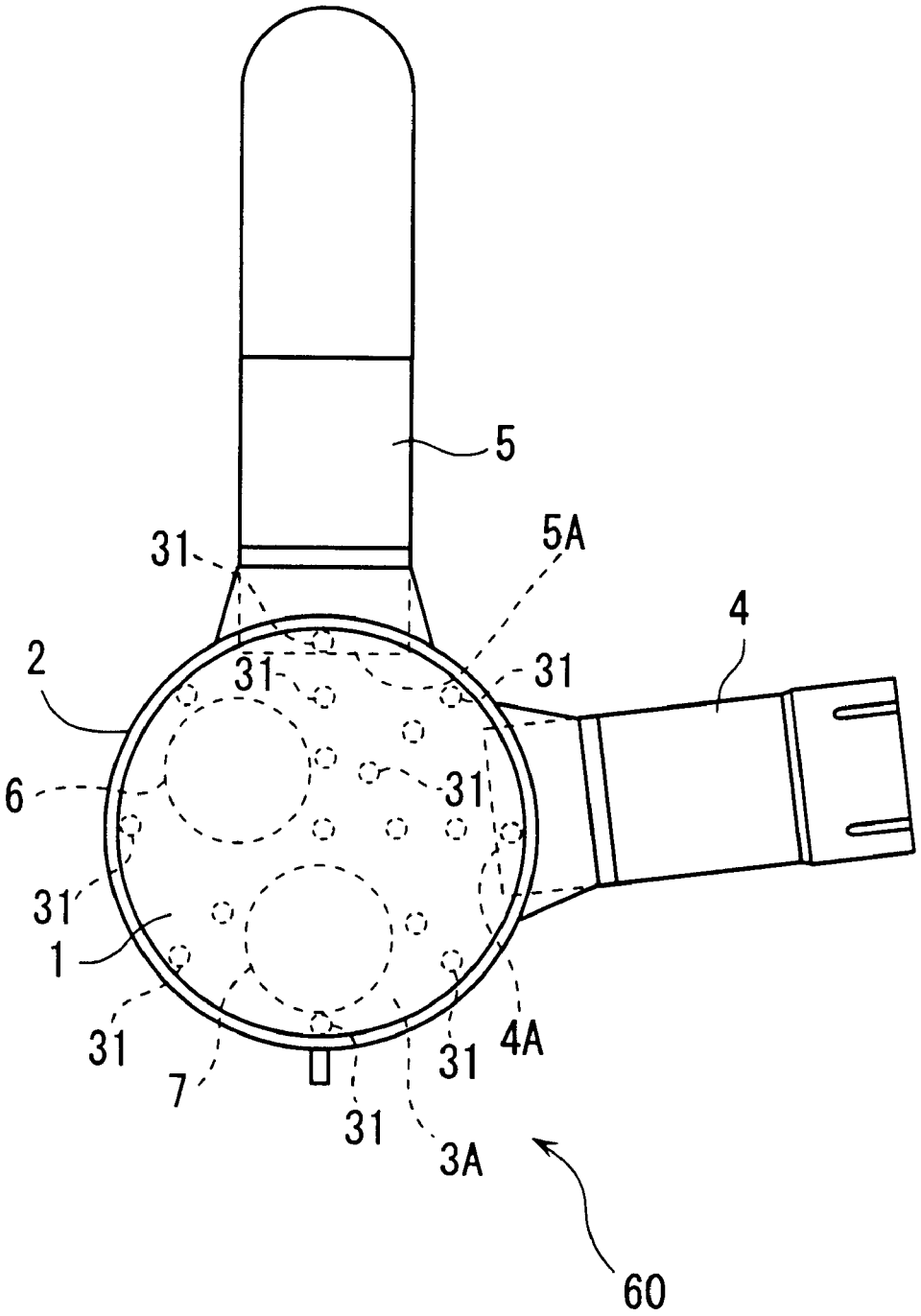
FIG. 10 is a side elevation of FIG. 9.

As shown in FIG. 10, the small holes 31 are disposed around the first communicating pipe 6 and the second communicating pipe 7 being spaced apart at a predetermined interval.

In the sixth embodiment, the main flow path for circulating the majority of the exhaust gas is formed by the first damping chamber 2A, the communicating holes 8A1, the inside of the first communicating pipe 6, the communicating holes 8A2, the second damping chamber 2B, the communicating holes 8A3, the inside of the second communicating pipe 7, the communicating holes 8A4 and the third damping chamber 2C, and the by-path flow path for circulating a part of the exhaust gas is formed by the small holes 31 formed on the partitions 3A and 3B.

As in the fifth embodiment, the cross section (opening area) of the by-path flow path is arranged so that the amount of the exhaust gas circulating therein is 5 to 30%, more preferably, 10 to 20% of the exhaust gas flowing the inside of the entire silencer.

A function of the sixth embodiment will be briefly described below.

The exhaust gas introduced from the diesel engine into the exhaust gas inlet pipe 4 flows into the first damping chamber 2A, of which majority passes the main flow path and the rest passes the small holes 31 constituting the by-path flow path.

In the main flow path, the exhaust gas flows into the inside of the communicating pipe 6 by being contracted by the communicating holes 8A1 of the communicating pipe 6. Subsequently, the flow of the exhaust gas flowing into the inside of the communicating pipe 6 is straightened with flow direction thereof being turned in the axial direction in the pipe and, on lower-stream side, the exhaust gas again turns direction thereof in a right angle by the communicating holes 8A2 to straighten the flow thereof, which is discharged to the second damping chamber 2B while being expanded.

In the second damping chamber 2B, the exhaust gas passing the small holes 31 of the first partition 3A joins with the exhaust gas passing the main flow path, where the exhaust noise of the main flow path and the by-path flow path mutually interferes, thus being damped.

The majority of the exhaust gas flowed into the second damping chamber 2B passes the main flow path and the rest passes the small holes 31 constituting the by-path flow path.

In the main flow path, the exhaust gas initially passes the communicating holes 8A3 of the second communicating pipe 7 to be flowed thereinto. Subsequently, the exhaust gas turns direction thereof in the axial direction to be circulated, and after being straightened flow thereof by the communicating holes 8A4, the exhaust gas is discharged to the third damping chamber 2C while being expanded.

On the other hand, the rest of the exhaust gas flows into the third damping chamber 3C through the small holes 31 of the second partition 3B to be joined with the exhaust gas passing the main flow path in the third damping chamber 3C thus being interfered with each other for damping sound thereof.

The exhaust gas flowed into the third damping chamber 2C is discharged to the outside through the tail pipe 5.

According to the above sixth embodiment, effects shown in (16) to (21) of the fifth embodiment can be attained.

[Seventh Embodiment]

Next, seventh embodiment of the present invention will be described with reference to FIG. 11.

The seventh embodiment differs from the sixth embodiment in a location of the by-path flow path and the rest of the basic arrangement is the same as the sixth embodiment.

Figure 11:
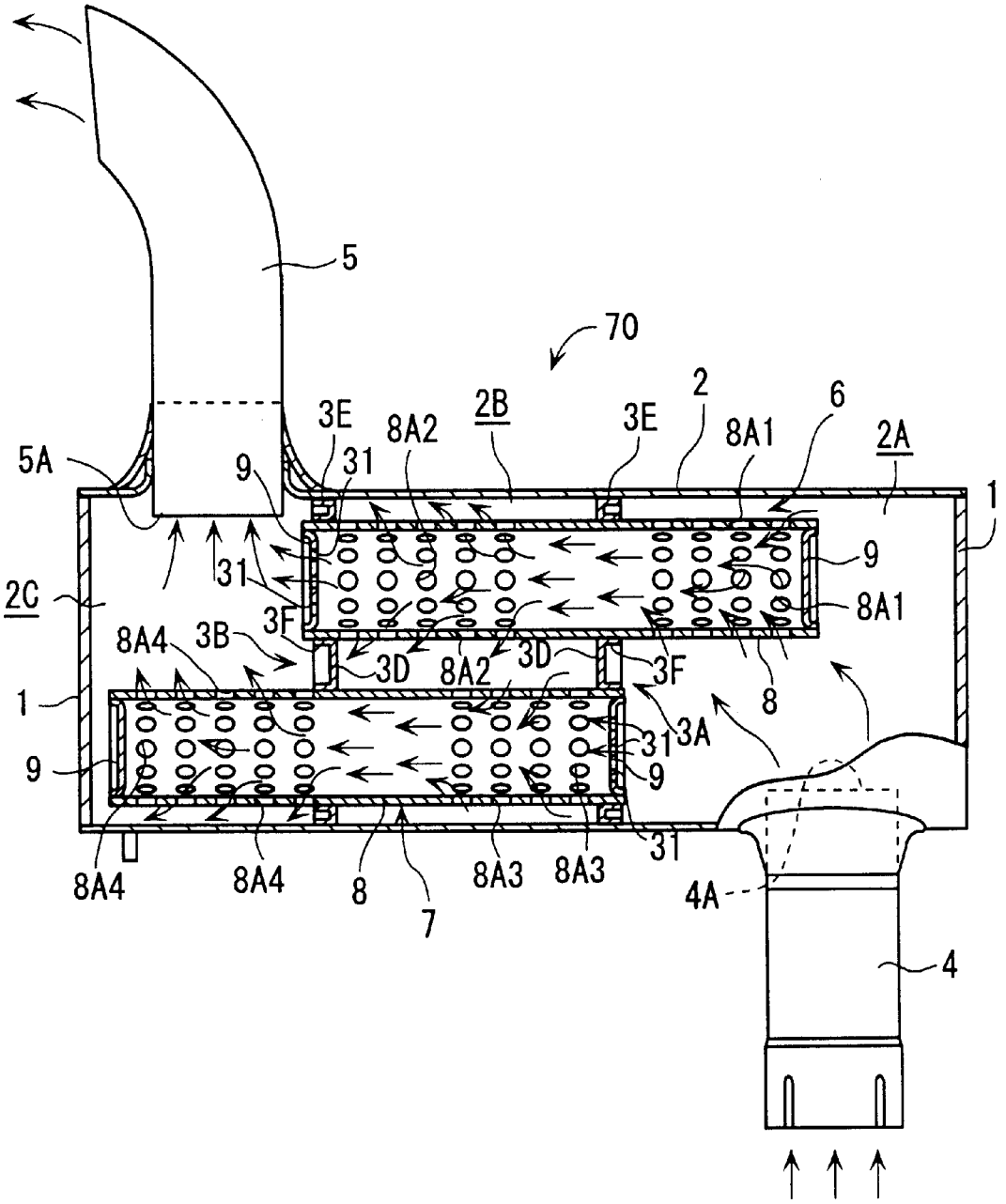
FIG. 11 is a cross section showing entire structure of an exhaust silencer according to seventh embodiment of the present invention.

In FIG. 11, an exhaust silencer 70 according to the seventh embodiment has a plurality of small hole 31 as a by-path flow path to lower-stream side end plate 9 of the first communicating pipe 6 and upstream side end plate of the second communicating pipe 7.

In the seventh embodiment, the main flow path is formed as in the sixth embodiment.

The cross section (opening area) of the by-path flow path of the seventh embodiment is arranged so that the amount of the exhaust gas circulating therein is 5 to 30%, more preferably, 10 to 20% of the exhaust gas flowing the inside of the entire silencer as in the fifth and sixth embodiment.

A function of the seventh embodiment will be briefly described below.

In the seventh embodiment, the majority of the exhaust gas flowed from a diesel engine into the first damping chamber 2A through the exhaust gas inlet pipe 4 passes the inside of the first communicating pipe 6 by being contracted by the communicating hole 8A1 of the first communicating pipe 6 and the rest flows into the inside of the second communicating pipe 7 through the small holes 31.

The exhaust gas flowed into the inside of the first communicating pipe 6 turns direction thereof inside the pipe to be straightened flow thereof. Subsequently, after the majority of the exhaust gas again turns circulation direction in a right angle by the lower-stream communicating holes 8A2 and is straightened the flow thereof, the majority of the exhaust gas is flowed out into the second damping chamber 2B and the rest flows out into the third damping chamber 3C through the small holes 31.

The exhaust gas flowed into the second damping chamber 2B is sent into the inside of the second communicating pipe 7 through the communicating holes 8A3, which joins with the exhaust gas passing from the first damping chamber 2A through the small holes 31 of the second communicating pipe 7 for mutual interference of the exhaust noise to be damped.

Further, the exhaust gas circulates inside the second communicating pipe 7 after turning in the axial direction, where the flow thereof is straightened by the communicating hole 8A4 to be discharged to the third damping chamber 2C.

In the third damping chamber 3C, the exhaust gas passing the small holes 31 of the first communicating pipe 6 and the exhaust gas passing through the communicating holes **8*a*4 of the second communicating pipe 6** join together to be interfere with each other for damping sound thereof.

The exhaust gas flowed into the third damping chamber 2C is discharged to the outside through the tail pipe 5.

According to the above seventh embodiment, effects (16) to (17) and (21) to (23) of the fifth embodiment can be obtained.

[Eighth Embodiment]

Next, eighth embodiment of the present invention will be described below with reference to FIG. 12.

Figure 12:
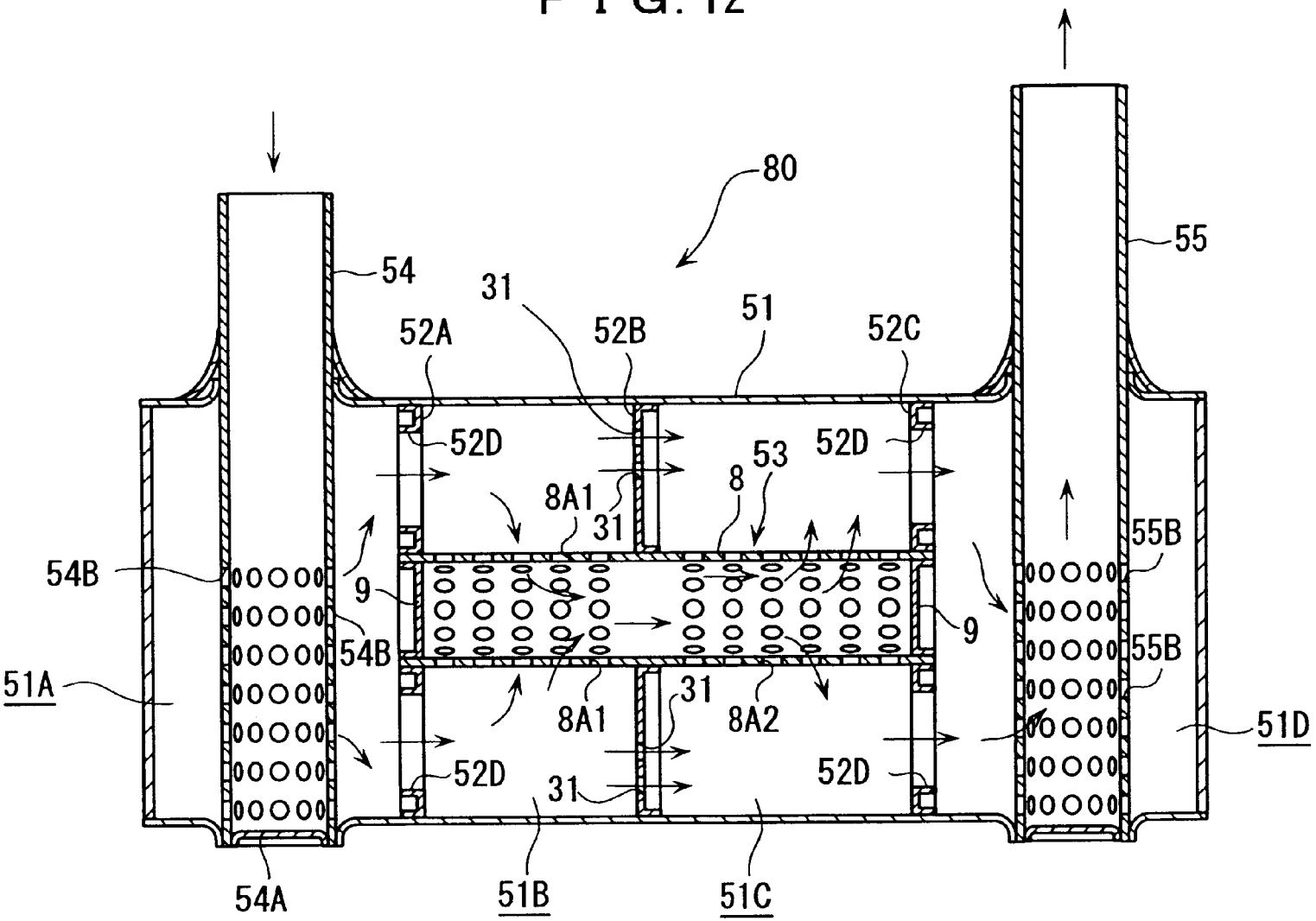
FIG. 12 is a cross section showing entire structure of an exhaust silencer according to eighth embodiment of the present invention.
Figure 15:
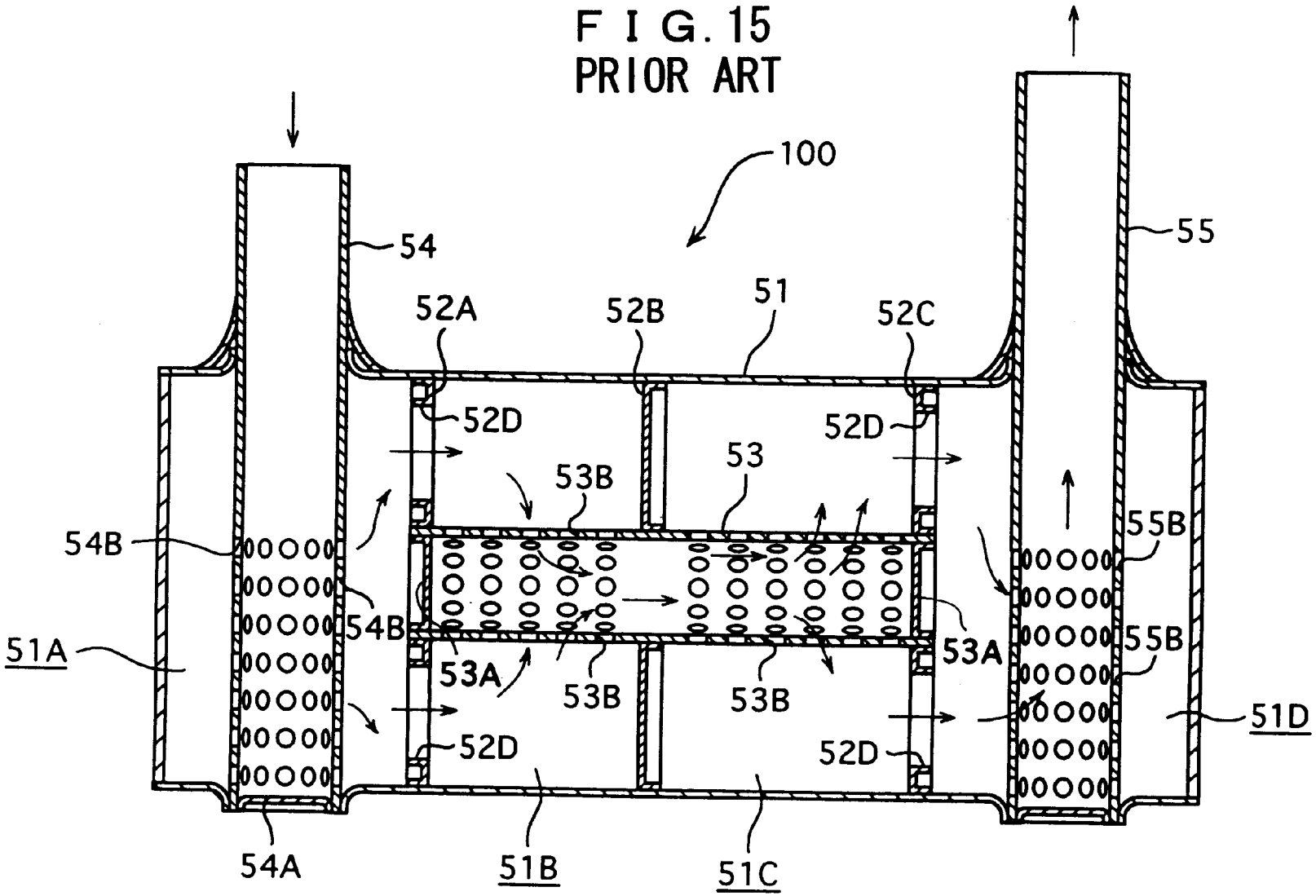
FIG. 15 PRIOR ART
FIG. 15 is a cross section showing a conventional example.

In FIG. 12, the exhaust silencer 80 of the eighth embodiment has the same basic arrangement as the above-described conventional example (see FIG. 15) and the same reference numeral will be applied to the same components to omit description therefor. Accordingly, only components peculiar to the present embodiment will be described below.

A partition 52B disposed at the center has a plurality of small holes 31 as the by-path flow path.

In the eighth embodiment, the main flow path is composed of the inside of the inlet pipe 54, the communicating holes 54B, the first damping chamber 51A, the opening 52D, the second damping chamber 51B, the communicating hole 8A1, the inside of the communicating pipe 6, the communicating hole 8A2, the third damping chamber 51C, the opening 52D, the fourth damping chamber, the communicating holes 55B and the inside of the outlet pipe 55.

As in the above respective embodiments, the cross section (opening area) of the by-path flow path of the eighth embodiment is arranged so that the amount of the exhaust gas circulating therein is 5 to 30%, more preferably, 10 to 20% of the exhaust gas flowing the inside of the entire silencer.

A function of the eighth embodiment will be briefly described below.

In the eighth embodiment, the exhaust gas introduced from the outlet pipe flows out into the first damping chamber 51A after the flow thereof is straightened in radial direction by the communicating holes 54B of the inlet pipe 54, and flows out from the first damping chamber 51A to the second damping chamber 51B through the opening 52D. Subsequently, the majority of the exhaust gas flows into the inside of the communicating pipe 6 after being contracted passing through the communicating holes 8A1, and the rest of the exhaust gas flows into the third damping chamber 51C through the small holes 31 of the partition 52B.

The exhaust gas flowed inside the communicating pipe 6 circulates with the direction thereof being turned into the axial direction, which is expanded and flowed out to the third damping chamber 51C through the communicating holes 8A2.

In the third damping chamber 51C, the exhaust gas passing through the communicating holes 8A2 constituting the main flow path and the exhaust gas passing through the small holes 31 constituting the by-path flow path join together to interfere with each other to damp the exhaust noise.

Thereafter, the exhaust gas flows from the third damping chamber 51C to the fourth damping chamber 51D through the opening 53D, which further flows into the outlet pipe 55 through the communicating holes 55B to be discharged into the air.

According to the above eighth embodiment, effects similar to (16) to (20) and (22) of the fifth embodiment can be obtained.

[Ninth Embodiment]

Next, the ninth embodiment of the present invention will be described with reference to FIG. 13.

The ninth embodiment differs from the eighth embodiment in the arrangement of the damping chamber and the communicating pipe, and the rest of the arrangement is the same as the eighth embodiment.

Figure 13:
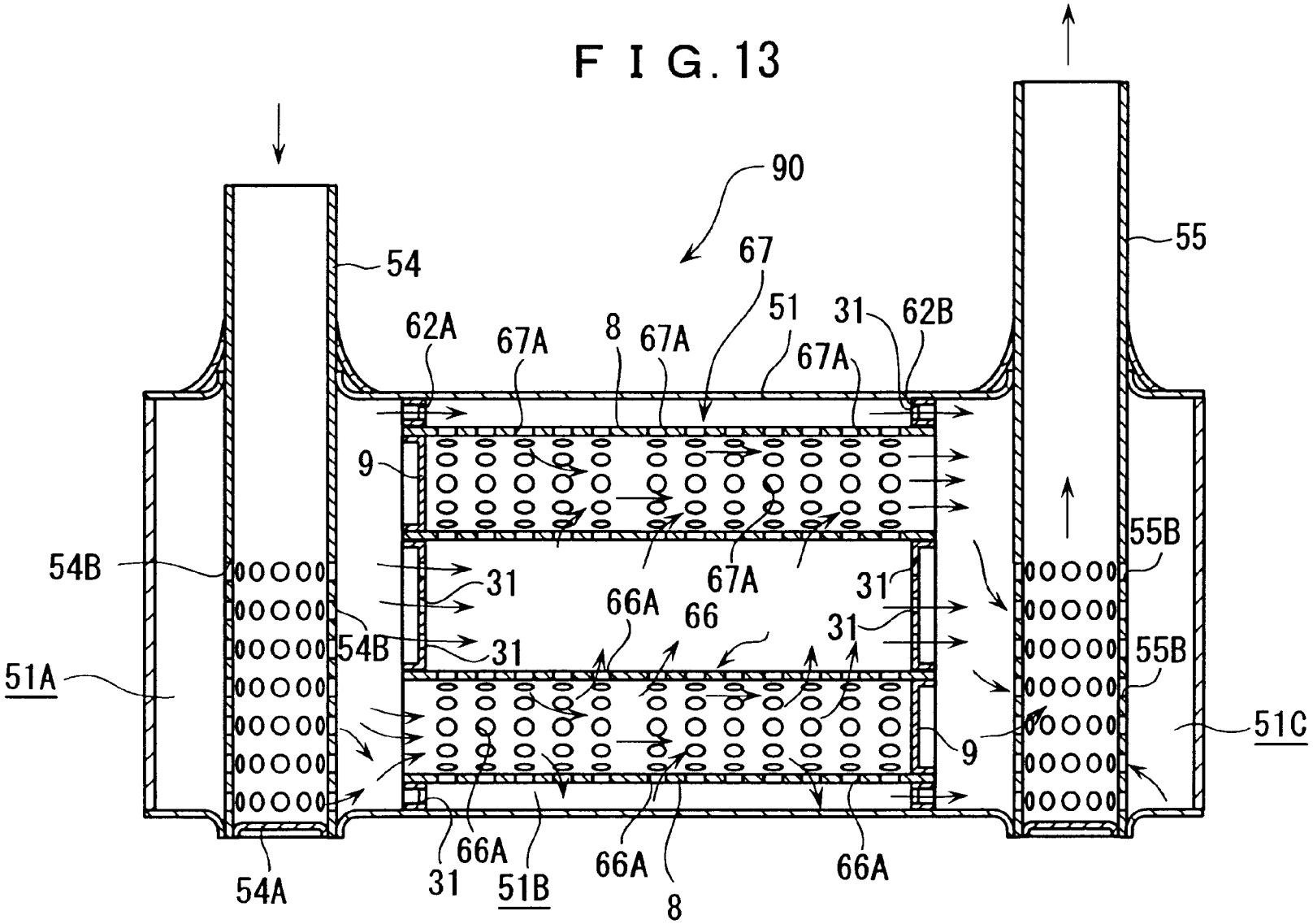
FIG. 13 is a cross section showing entire structure of an exhaust silencer according to ninth embodiment of the present invention.

In FIG. 13, an exhaust silencer 90 of the ninth embodiment has two partitions 62A and 62B for dividing the inside of the drum-shaped body 51 into three damping chambers 51A to 51C disposed parallel in axial direction. First and second communicating pipes 66 and 67 are supported by the partitions 62A and 62B parallel to the axis of the body 51. An end portion and intermediate portion of the inlet pipe 54 is fixed to the body 51 to face the uppermost-stream damping chamber 51A, and an end portion and intermediate portion of the outlet pipe 55 is fixed to the body 51 to face the lowermost-stream damping chamber 51C.

The first communicating pipe 66 has a cylindrical member 18 having a large number of communicating holes 66A facing the second damping chamber 51B on a circumference thereof, and an end plate 9 for closing an open end facing the third damping chamber 51C of the cylindrical member 18.

The second communicating pipe 67 has the cylindrical member 18 having the communicating holes 67A formed on a circumference thereof and the end plate 9 for closing the opening end of the cylindrical member 18 facing the first damping chamber 51A.

A plurality of small holes 31 as the by-path flow path is formed on the partitions 62A and 62B.

In the ninth embodiment, the main flow path is formed of the inside of the inlet pipe 54, the communicating hole 54B, the first damping chamber 51A, the inside of the first communicating pipe 66, the communicating holes 66A, the second damping chamber 51B, the communicating holes 67A, the second communicating holes 67, the third damping chamber 51C, the communicating holes 55B and the inside of the outlet pipe 55.

As in the above respective embodiments, the cross section (opening area) of the by-path flow path of the eighth embodiment is arranged so that the amount of the exhaust gas circulating therein is 5 to 30%, more preferably, 10 to 20% of the exhaust gas flowing the inside of the entire silencer.

A function of the ninth embodiment will be briefly described.

In the ninth embodiment, the exhaust gas introduced from the outlet pipe flows out into the first damping chamber 51A through the communicating holes 54B of the inlet pipe 54 into the first damping chamber 51A. The majority of the exhaust gas passes the first communicating pipe 66 constituting the main flow path and the rest flows to the second damping chamber 51B through the small holes 31 of the partition 62A as the sub flow path.

The exhaust gas passing through the inside of the first communicating pipe 66 is contracted by the communicating holes 66A to flow into the second damping chamber 51B, which joins with the exhaust gas passing through the small holes 31 of the partition 62B to interfere with each other to be damped.

The majority of the exhaust gas of the second damping chamber 51B is contracted inside the second communicating pipe 67 through the communicating holes 67A as the main flow path, which flows into the third damping chamber 51C. The rest directly flows into the third damping chamber 51C through the small holes 31 as the by-path flow path.

The exhaust gas separately flowed from the main flow path and the by-path flow path join together in the third damping chamber 51C to interfere with each other for sound damping.

Further, the exhaust gas flows into the outlet pipe 55 from the third damping chamber 51C to the outlet pipe 55 through the communicating holes 55B to be discharged into the air.

According to the ninth embodiment, effects similar to (16) to (18) and (23) of the fifth embodiment can be obtained.

Incidentally, the scope of the present invention is not limited to the above-described embodiments, but includes modification and improvement as long as an object of the present invention can be achieved.

In the present invention, the size and location of the communicating holes 8A1 to 8A4 is not limited to the above embodiments. For instance, though the number and the total opening area of the communicating holes 8A1 on the position into which the exhaust gas flows is smaller than the number and the total opening area of the communicating holes 8A2 from which the exhaust gas flows out in the above embodiment, reverse arrangement is possible in the present invention, or alternatively, the communicating holes may be arranged equally to the communicating pipe without deviation.

Figure 14A:
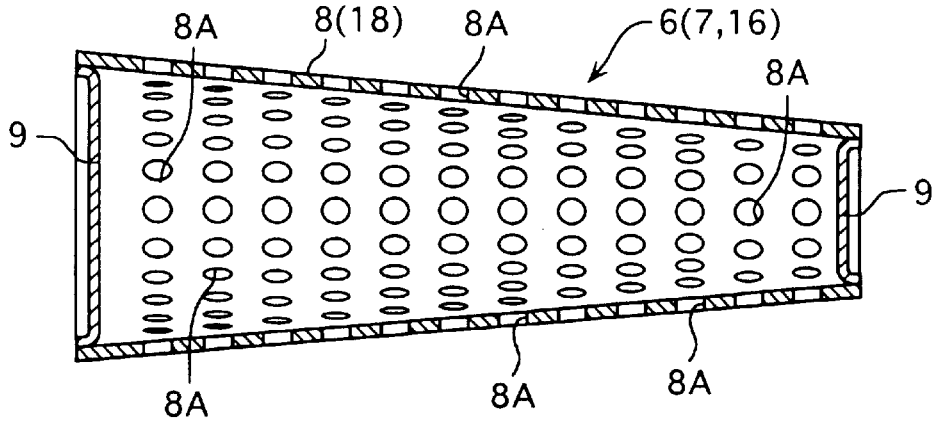
FIGS. 14(A) to FIG. 14(D) are cross sections showing modifications of the present invention.
Figure 14B:
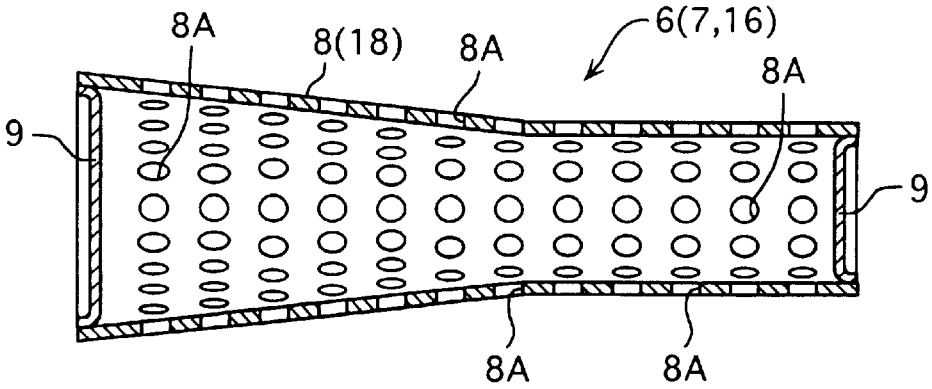

Though the cylindrical members 8 and 18 are formed in straight shape having uniform cross section along axial direction in the aforesaid embodiments, the cylindrical member 8 and 18 may be configured in a tapered shape having larger diameter in upstream side than lower-stream side as shown in FIG. 14(A), or as shown in FIG. 14(B), the cylindrical member may have straight shape from the upstream side to the intermediate portion and tapered shape with a cross section enlarged from the intermediate portion to the lower-stream side. A large number of the communicating holes 8A is formed on the entire surface of the outer circumference of the cylindrical member 8 and 18.

As described above, since the outer circumferences of the communicating pipe 6, 7 and 16 are formed in a tapered shape, the flow velocity of the exhaust gas in the communicating pipes 6, 7 and 16 can be reduced as going down to the lower stream, or the exhaust gas can be expanded in the communicating pipes 6, 7 and 16, thus reducing jet noise generated in the communicating pipes.

Figure 14C:
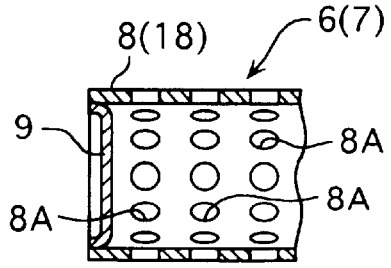
Figure 14D:
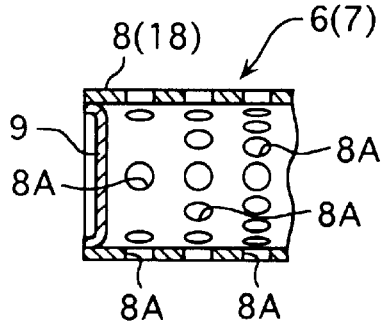

In the present invention, the opening area of the communicating holes 8A may be reduced adjacent to lower-stream side of the communicating pipes 6 and 7 as shown in FIG. 14(C) in order to attain effects similar to the communicating pipes 36 and 37 in FIG. 5. Alternatively, disposition interval of the communicating holes 8A may be widened adjacent to the lower-stream side of the communicating pipes 6 and 7 as shown in FIG. 14(D). In other words, the opening area of the communicating holes 8A of the communicating pipes 6 and 7 may be reduced toward the lower-stream of the exhaust flow.

According to the above arrangement, since the exhaust gas can more easily flow out as approaching toward the upstream side, the exhaust gas does not concentrate to a specific point, thus obtaining effects similar to contracting the pipe on lower-stream side.

In the second embodiment, the partitioning wall 19 may not be necessarily required. When the partitioning wall 19 is provided, the location thereof is not required to be the outer circumference of the cutoff partition 17, but may be separated from the cutoff partition 17 in a predetermined distance in the axial direction. The cutoff partition 17 may have profile of other configuration such as rectangular and polygonal.

in the above fifth, sixth, seventh and ninth embodiments, the by-path flow path is constituted of the small holes 31 formed on the partition and, in the seventh embodiment, the by-path flow path is formed by the small holes 31 formed on the end plate 9 of the communicating pipes 16 and 17. However, the small holes 31 may be formed on both of the partition and the end plate 9 to constitute the by-path flow path, or alternatively, a by-pass channel of a pipe in communication with mutually adjacent damping chambers may be provided for forming the by-path flow path.

When the by-path flow path is formed of the small holes 31, the number is not limited and the sub flow path can be formed of, for instance, one small hole 31.

The respective exhaust silencers 10 to 90 may also have a resonant chamber.

Though the exhaust silencers 10 to 90 are applied to a diesel engine, they may be applied to internal combustion engine such as a gasoline engine and the combustion engine is not limited to be used for construction equipment but may be used for passenger car etc.

What is claimed is:

1. An exhaust silencer to be connected to an outlet pipe of an internal combustion engine, comprising:

a plurality of damping chambers of more than two, the plurality of damping chambers having an uppermost-stream damping chamber having an exhaust gas inlet for directly introducing exhaust gas of the internal combustion engine, and lowermost-stream damping chamber having an exhaust gas outlet for discharging the exhaust gas; and a communicating pipe for intercommunicating predetermined space of the plurality of damping chambers, the communicating pipe having an end plate on both ends and a number of communicating holes on an outer circumference at a predetermined position corresponding to the damping chamber to be intercommunicated, wherein a total opening area of the communicating holes on the communicating pipe open to the uppermost-stream damping chamber is smaller than respective total opening area of the communicating holes open to lower-stream damping chamber.

2. The exhaust silencer according to claim 1, wherein a volume of the damping chamber on the uppermost-stream side is the largest of the plurality of damping chambers.

3. The exhaust silencer according to claim 1, wherein a volume of a damping chamber to which the communicating holes of the communicating pipe having the least total opening area directly opens is the largest.

4. The exhaust silencer according to claim 1, further comprising a communicating portion for flowing the exhaust gas in an axial direction is provided to the end plates on either or both ends of the communicating pipe.

5. The exhaust silencer according to claim 1, wherein a cross section of the upstream communicating pipe is smaller than lower-stream communicating pipe.

6. The exhaust silencer according to claim 1, wherein an entirety of the communicating pipe is formed of a single consecutive communicating pipe; and wherein a communicating pipe cutoff partition is formed to an intermediate position of respective damping chambers except for the uppermost-stream damping chamber and the lowermost-stream damping chamber.

7. The exhaust silencer according to claim 6, wherein a partitioning wall for partitioning a part of the respective damping chambers are provided to an outer circumference of the cutoff partition.

8. The exhaust silencer according to claim 1, wherein an opening area of the communicating holes of the communicating pipe becomes smaller toward lower-stream side in exhaust flow direction.

9. The exhaust silencer according to claim 1, further comprising a communicating portion for by-passing the exhaust gas is provided to a partitioning portion for partitioning mutually adjacent damping chambers.

10. A communicating pipe used for an exhaust silencer having a plurality of damping chamber; the plurality of damping chambers having an uppermost-stream damping chamber an exhaust gas inlet for directly introducing exhaust gas of the internal combustion engine, and lowermost-stream damping chamber having an exhaust gas outlet for discharging the exhaust gas, the communicating pipe being used for intercommunicating a predetermined chambers of the plurality of the damping chambers, comprising:

an end plate provided at least to a lower-stream end; and a large number of communicating holes provided to a predetermined position on an outer circumference corresponding to the chamber to be intercommunicated, the end plate on the lower-stream end being a hollow plate dented toward inside, wherein a total opening area of the communicating holes on the communicating pipe open to the uppermost-stream damping chamber is smaller than respective total opening area of the communicating holes open to lower-stream damping chamber.

11. An exhaust silencer connected to an outlet pipe of a combustion engine for damping exhaust noise by contracting and expanding a flow path for exhaust gas to be circulated, comprising:

a main flow path for circulating majority of the exhaust gas; and at least one by-path flow path for constantly circulating a part of the exhaust gas, wherein cross section of the by-path flow path is defined so that amount of the exhaust gas circulating therein is 5 to 30% of total exhaust gas circulating in the entire silencer.

12. The exhaust silencer according to claim 11, further comprising:

a plurality of damping chamber;

a partition for dividing the plurality of the damping chamber; and a communicating pipe for intercommunicating the plurality of the damping chamber;

the partition having at least one communicating portion for circulating the exhaust gas.

* * * * *